US007350722B2

(12) United States Patent
Shanklin et al.

(10) Patent No.: US 7,350,722 B2
(45) Date of Patent: Apr. 1, 2008

(54) SINGLE VALVE READY TO USE SPRAYER

(75) Inventors: Donald J. Shanklin, Corona, CA (US); Ronald F. Englhard, Dove Canyon, CA (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 306 days.

(21) Appl. No.: 11/053,384

(22) Filed: Feb. 8, 2005

(65) Prior Publication Data

US 2005/0173567 A1 Aug. 11, 2005

Related U.S. Application Data

(60) Provisional application No. 60/543,992, filed on Feb. 11, 2004.

(51) Int. Cl.

| | |
|---|---|
| ***A62C 5/02*** | (2006.01) |
| ***B05B 7/26*** | (2006.01) |
| *F23D 11/46* | (2006.01) |
| *F23D 14/60* | (2006.01) |

(52) U.S. Cl. ..... 239/318; 239/310; 239/398; 239/414; 239/525; 239/586; 222/484

(58) Field of Classification Search ..... 239/569, 239/581.2, 582.2, 10, 310, 414, 413, 407, 239/318; 137/247, 250, 897, 896, 625.41
See application file for complete search history.

(56) References Cited

U.S. PATENT DOCUMENTS

| | | | |
|---|---|---|---|
| 667,491 | A | 2/1901 | Brigham |
| 1,813,581 | A | 7/1931 | Rodrigues |
| 2,571,871 | A | 10/1951 | Hayes |
| 2,719,704 | A | 10/1955 | Anderson et al. |
| 2,764,452 | A | 9/1956 | Anderson et al. |
| 2,788,244 | A | 4/1957 | Gilmour |
| 2,837,374 | A | 6/1958 | Lipman |
| 3,064,683 | A | 11/1962 | Nordstrand |
| 3,090,564 | A | 5/1963 | Gilmour |
| 3,122,325 | A | 2/1964 | Mahrt et al. |
| 3,134,545 | A | 5/1964 | Armond |
| 3,180,580 | A | 4/1965 | Schedel |
| 3,186,643 | A | 6/1965 | George et al. |
| 3,207,443 | A | 9/1965 | Gilmour |
| 3,212,716 | A | 10/1965 | Mills et al. |
| 3,231,200 | A | 1/1966 | Heald |
| 3,254,844 | A | 6/1966 | Blasnik et al. |
| 3,258,026 | A | 6/1966 | Weaver |
| 3,291,395 | A | 12/1966 | Sharp |
| 3,632,083 | A | 1/1972 | Meeks |
| 3,764,074 | A | 10/1973 | James |
| 3,768,777 | A | 10/1973 | Hechler |
| 3,770,205 | A | 11/1973 | Proctor et al. |
| 3,809,124 | A | 5/1974 | Nelson |
| 3,940,069 | A | 2/1976 | Gunzel, Jr. et al. |
| 4,008,878 | A | 2/1977 | Himmelman et al. |

(Continued)

*Primary Examiner*—Dinh Q. Nguyen
*Assistant Examiner*—James S Hogan

(57) ABSTRACT

A sprayer head assembly for dispensing a chemical stored within a container comprise a body having a bore and a valve moveably positioned at least partially within the bore. The housing includes passages for carrier fluid and the chemical. A vent passage is also provided. The valve selectively closes and opens the carrier fluid, chemical and vent passages. The valve is configured to rotate about an axis that extends in a generally vertical direction.

20 Claims, 25 Drawing Sheets

U.S. PATENT DOCUMENTS

RE29,405 E 9/1977 Gunzel, Jr. et al.
4,121,773 A 10/1978 Headen et al.
4,138,033 A 2/1979 Payne et al.
D254,146 S 2/1980 Koenig
4,281,796 A 8/1981 Fugent et al.
4,349,157 A 9/1982 Beiswenger et al.
4,369,921 A 1/1983 Beiswenger et al.
4,475,689 A 10/1984 Hauger et al.
4,508,272 A * 4/1985 Thompson ..... 239/318
4,595,127 A 6/1986 Stoody
4,640,461 A 2/1987 Williams
4,651,930 A 3/1987 Magaha, Jr.
4,736,891 A 4/1988 Chow et al.
4,750,674 A 6/1988 Chow et al.
4,767,058 A 8/1988 LaRosa et al.
4,811,900 A * 3/1989 LaRosa et al. ..... 239/10
4,826,085 A 5/1989 Chow et al.
4,838,490 A 6/1989 Nissels
4,878,619 A 11/1989 Norman
4,881,575 A 11/1989 Smith
4,901,923 A 2/1990 McRoskey et al.
4,901,976 A 2/1990 Smith
4,969,603 A 11/1990 Norman
5,007,588 A 4/1991 Chow et al.
5,039,016 A 8/1991 Gunzel, Jr. et al.
5,100,059 A 3/1992 Englhard et al.
5,152,464 A 10/1992 Farley
5,213,264 A 5/1993 Styne
5,213,265 A * 5/1993 Englhard et al. ..... 239/310
5,320,288 A 6/1994 Ketcham, Jr.
5,356,076 A 10/1994 Bishop
5,372,310 A 12/1994 Ketcham
5,383,603 A 1/1995 Englhard et al.
D358,865 S 5/1995 Englhard et al.
5,595,345 A 1/1997 Chura et al.
5,649,664 A 7/1997 Brass et al.
5,655,563 A 8/1997 Johnson
5,850,973 A 12/1998 Liljeqvist et al.
5,945,160 A 8/1999 Kobak et al.
5,954,272 A 9/1999 Liao
D433,095 S 10/2000 Beauer et al.
6,267,304 B1 7/2001 Schultz
D451,581 S 12/2001 Shanklin et al.
6,345,773 B1 * 2/2002 Shanklin et al. ..... 239/318
6,378,785 B1 4/2002 Dodd
6,425,534 B2 7/2002 Ketcham et al.
6,471,141 B2 * 10/2002 Smith et al. ..... 239/10
6,578,776 B1 6/2003 Shanklin et al.
6,651,901 B2 11/2003 Jones
D484,572 S 12/2003 Shanklin et al.
6,655,660 B2 12/2003 Wales
6,672,520 B2 1/2004 Shanklin et al.
6,726,123 B2 4/2004 Wang
6,749,133 B1 6/2004 Ketcham et al.
6,772,966 B2 8/2004 Foster et al.
6,913,209 B2 * 7/2005 Shanklin et al. ..... 239/318
7,118,049 B2 * 10/2006 Dodd ..... 239/318
2004/0118944 A1 6/2004 Amaduzzi
2004/0124263 A1 7/2004 Seeman
2004/0140372 A1 7/2004 Englihard et al.
2005/0184171 A1 8/2005 Shanklin et al.
2005/0184172 A1 8/2005 Shanklin et al.
2005/0189436 A1 9/2005 Shanklin et al.
2005/0199751 A1 9/2005 Shanklin et al.
2005/0284961 A1 12/2005 Shanklin et al.
2006/0032943 A1 2/2006 Shanklin et al.

* cited by examiner

SINGLE VALVE READY TO USE SPRAYER

PRIORITY INFORMATION

This application claims the priority benefit under 35 U.S.C. § 119(e) of Provisional Application 60/543,992 filed Feb. 11, 2004.

BACKGROUND OF THE INVENTION

1. Field of the Invention

The present invention relates to chemical dispensing sprayers and, in particular, to aspiration-type sprayers that use a relatively large amount of carrier fluid for dispensing a relatively small amount of a chemical solution.

2. Description of the Related Art

Every year consumers apply thousands of gallons of chemicals such as fertilizers or pesticides to plants, lawns, flowers, vegetable gardens and other organic type vegetation. Typically, such chemicals are sold in plastic containers in a concentrated form. While in this concentrated form, the chemical is extremely hazardous to the consumer end user and the environment in general. Accordingly, the container typically includes an aspiration-type sprayer head assembly. An aspiration-type sprayer uses a relatively large amount of carrier fluid, such as water, to withdraw, dilute and dispense a relatively small amount of chemical from the container. To further prevent harm to the consumer, the container and the sprayer head assembly are preferably disposed of after the container's contents are exhausted. It is therefore desirable to provide a sprayer head assembly that is sufficiently low cost so as to allow the entire unit to be discarded and yet reliable and safe.

SUMMARY OF THE INVENTION

It is therefore an object of one embodiment to provide a safe and reliable aspiration type chemical sprayer that utilizes a minimum number of components and that is relatively easy to manufacture and assemble.

Accordingly, one embodiment if the present invention comprises a sprayer head assembly for dispensing a chemical. The sprayer head assembly comprises a body that includes a chemical passage, a carrier fluid passage and a vent passage. The carrier fluid passage is communication with a cavity in a container. A carrier fluid passage is in communication with a carrier fluid source. A vent passage is in communication with the cavity in the container. A bore is formed in the housing and is in communication with the, chemical, carrier fluid and vent passages. A valve is moveably positioned at least partially within the bore. The valve defines, at least in part, a first passage and a second passage. The first passage and the second passage merge at the valve. The first passage is configured so as to be in communication with the chemical passage when the valve is in an open position. The second passage is configured so as to be in communication with the carrier fluid passage when the valve is in the open position. Te first and second passages are also configured so as to not be in communication with the chemical and carrier fluid passages when the valve is in a closed position. The valve further comprises one or more sealing portions positioned on the valve so as to block both the chemical, the carrier fluid and the vent passages when the valve is in the closed position. The valve is configured to rotate about an axis that extends in a generally vertical direction.

All of these embodiments are intended to be within the scope of the invention herein disclosed. These and other embodiments of the present invention will become readily apparent to those skilled in the art from the following detailed description of the preferred embodiments having reference to the attached Figuers, the invention not being limited to any particular preferred embodiment(s) disclosed.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

BRIEF DESCRIPTION OF THE DRAWINGS

These and other features of the invention will now be described with reference to the drawings of the preferred embodiments, which are intended to illustrate and not to limit the invention, and in which.

Figure 12:
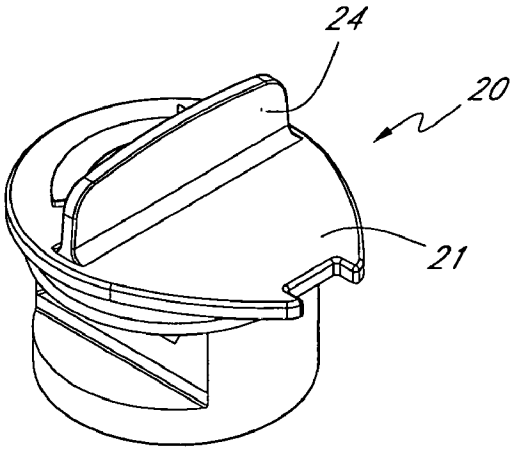
FIG. 12 is a top perspective view of the valve of FIG. 1, the valve comprising a first component (FIG. 19) and a second component (FIG. 23)
Figure 25:
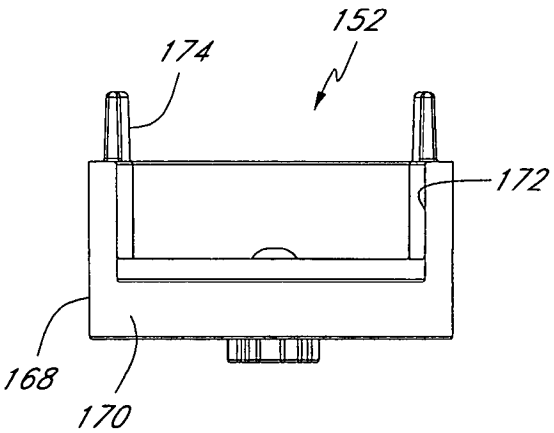
Figure 27:
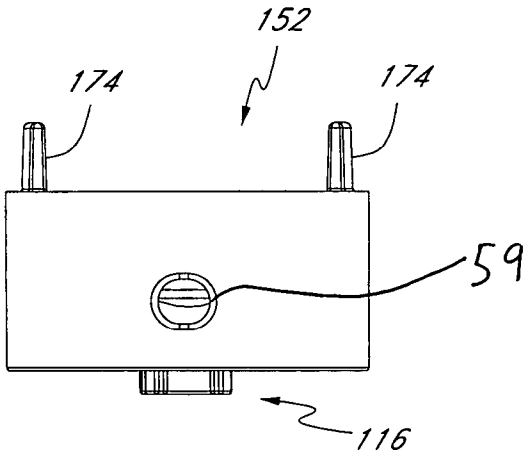
Figure 24:
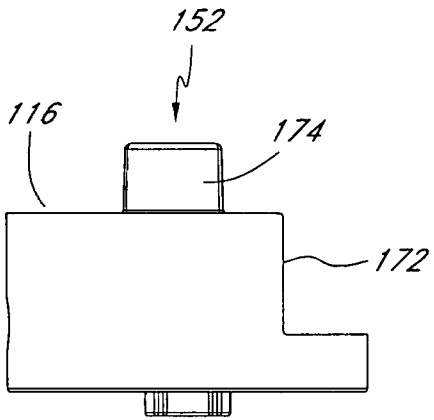
Figure 26:
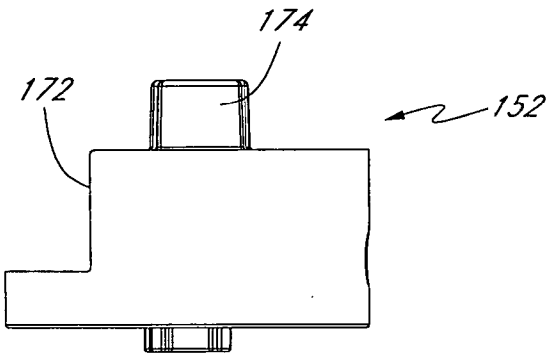
Figure 23:
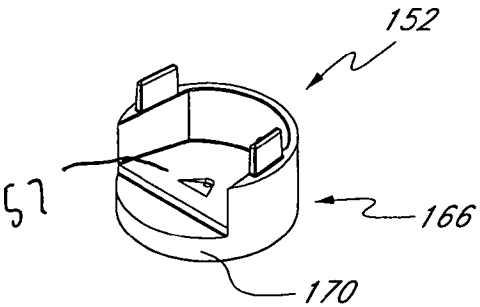
Figure 28A:
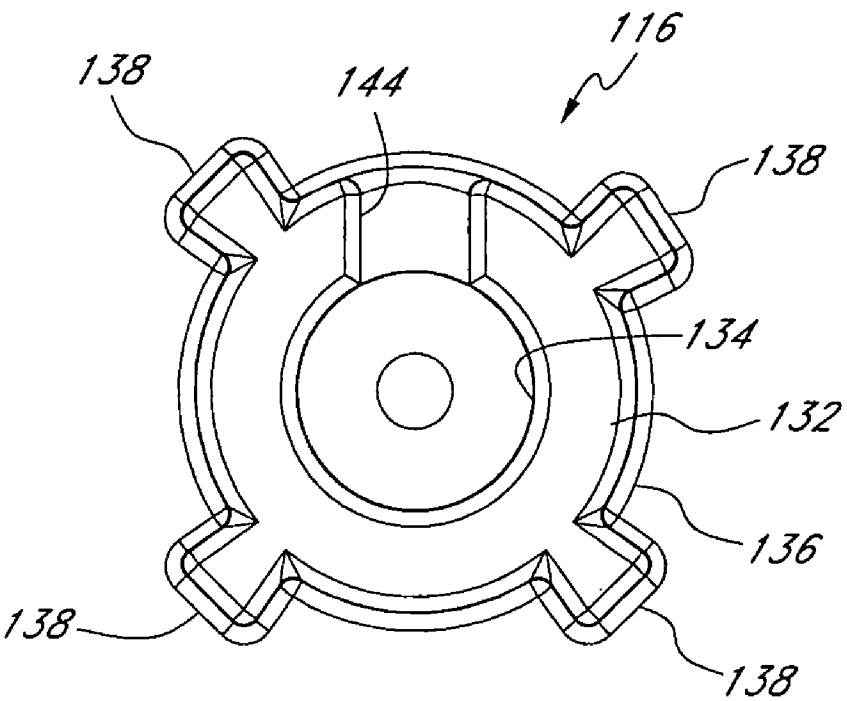
Figure 28:
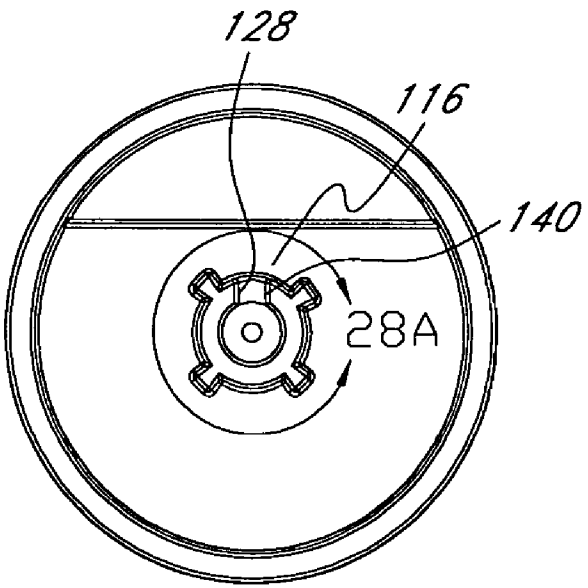
Figure 29B:
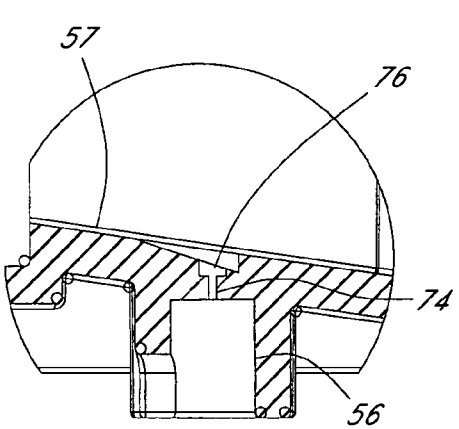
Figure 29D:
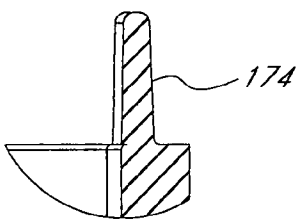
Figure 29A:
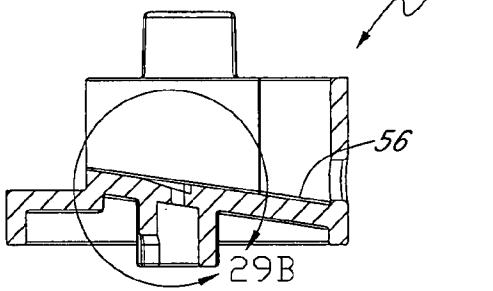
Figure 29C:
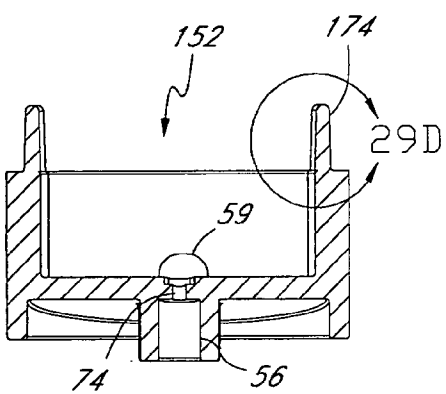
Figure 29:
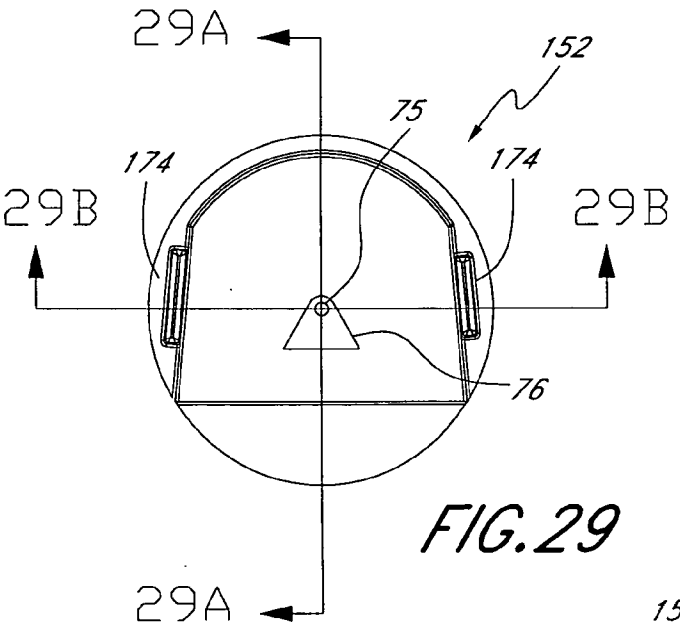
Figure 31B:
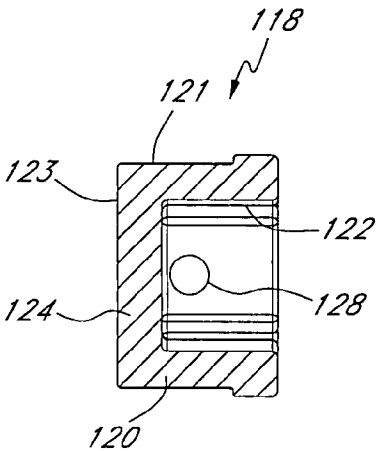
Figure 31C:
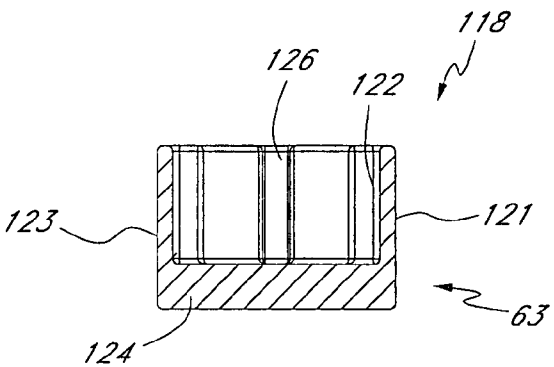
Figure 31A:
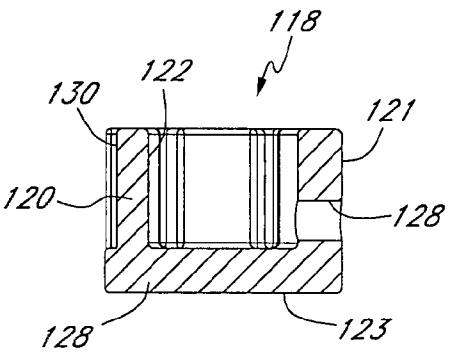
Figure 31:
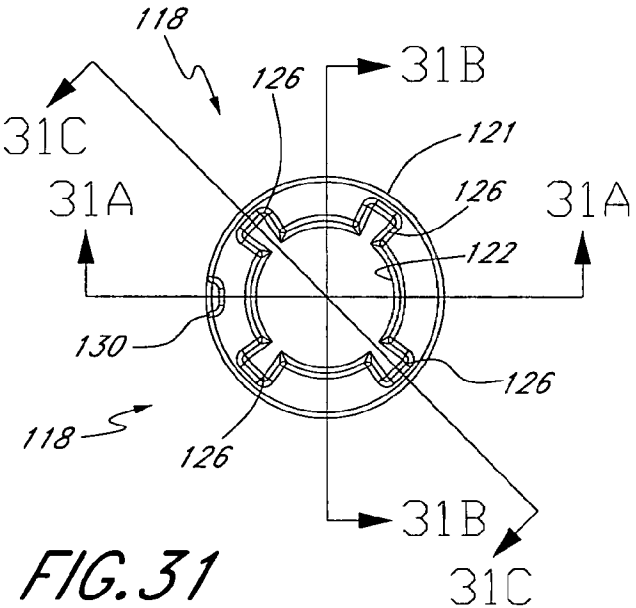
Figure 30:
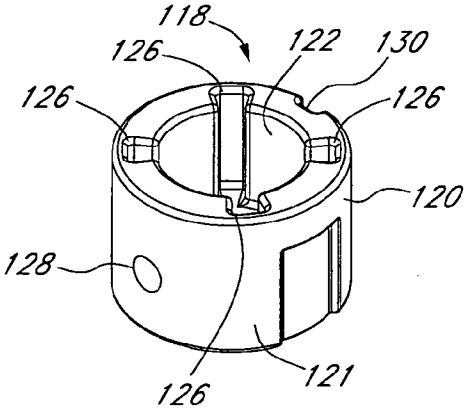
Figure 33A:
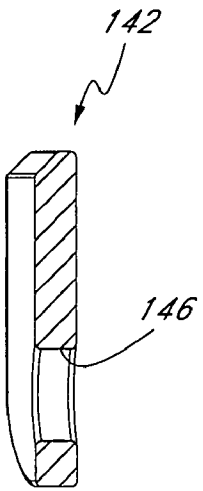
Figure 33:
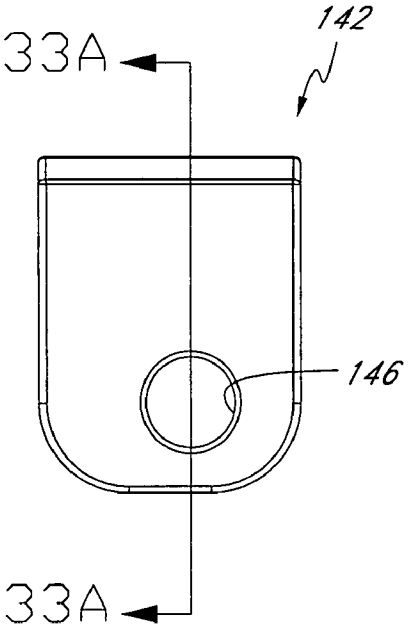
Figure 32:
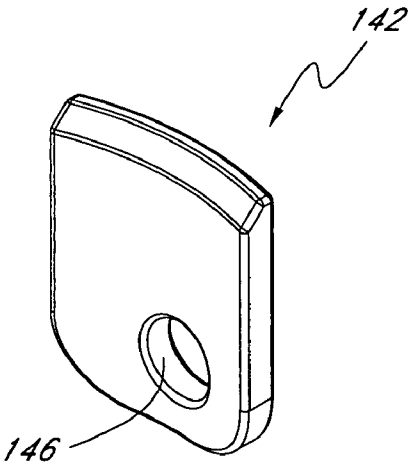
Figure 34:
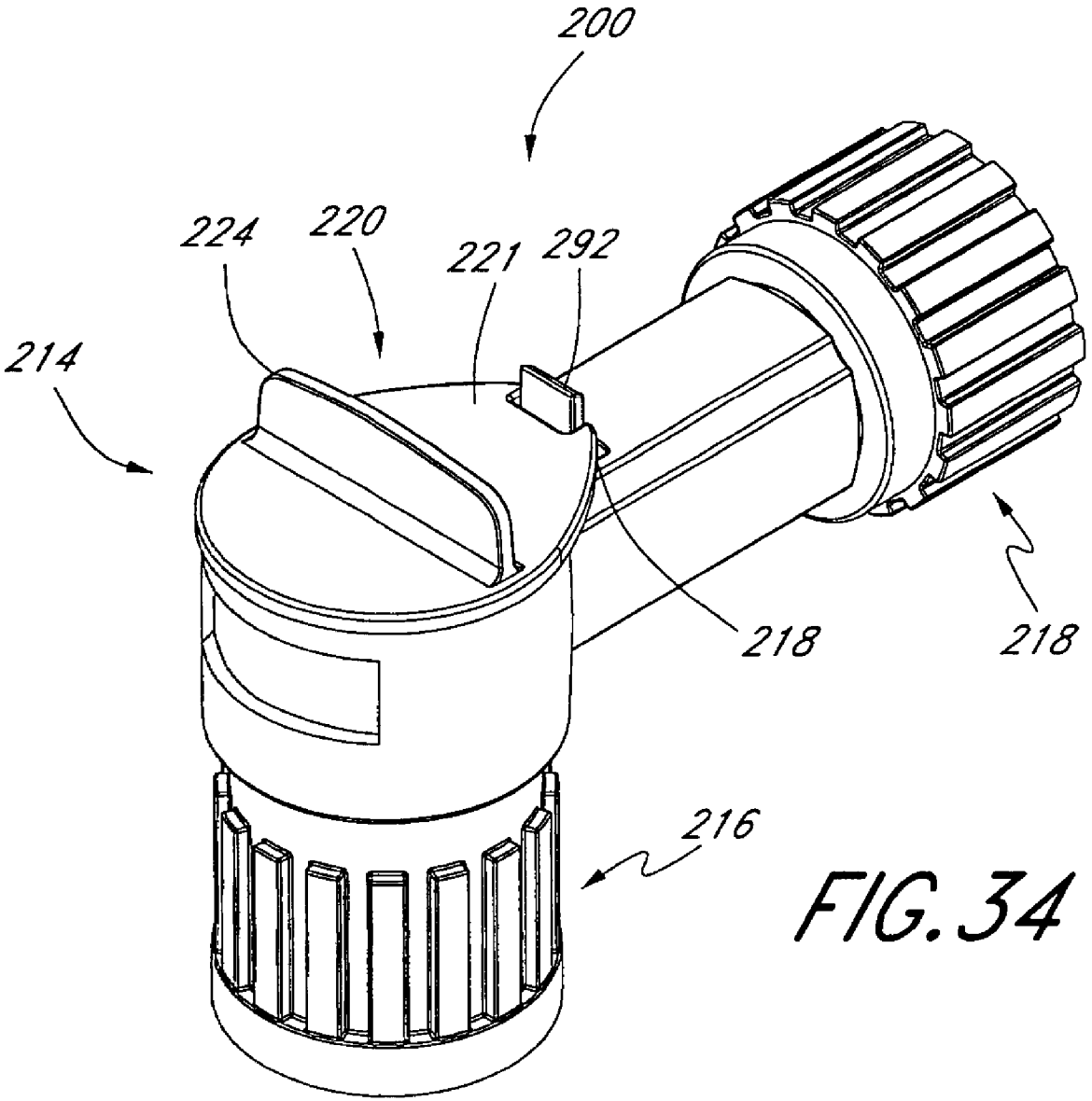
Figure 35:
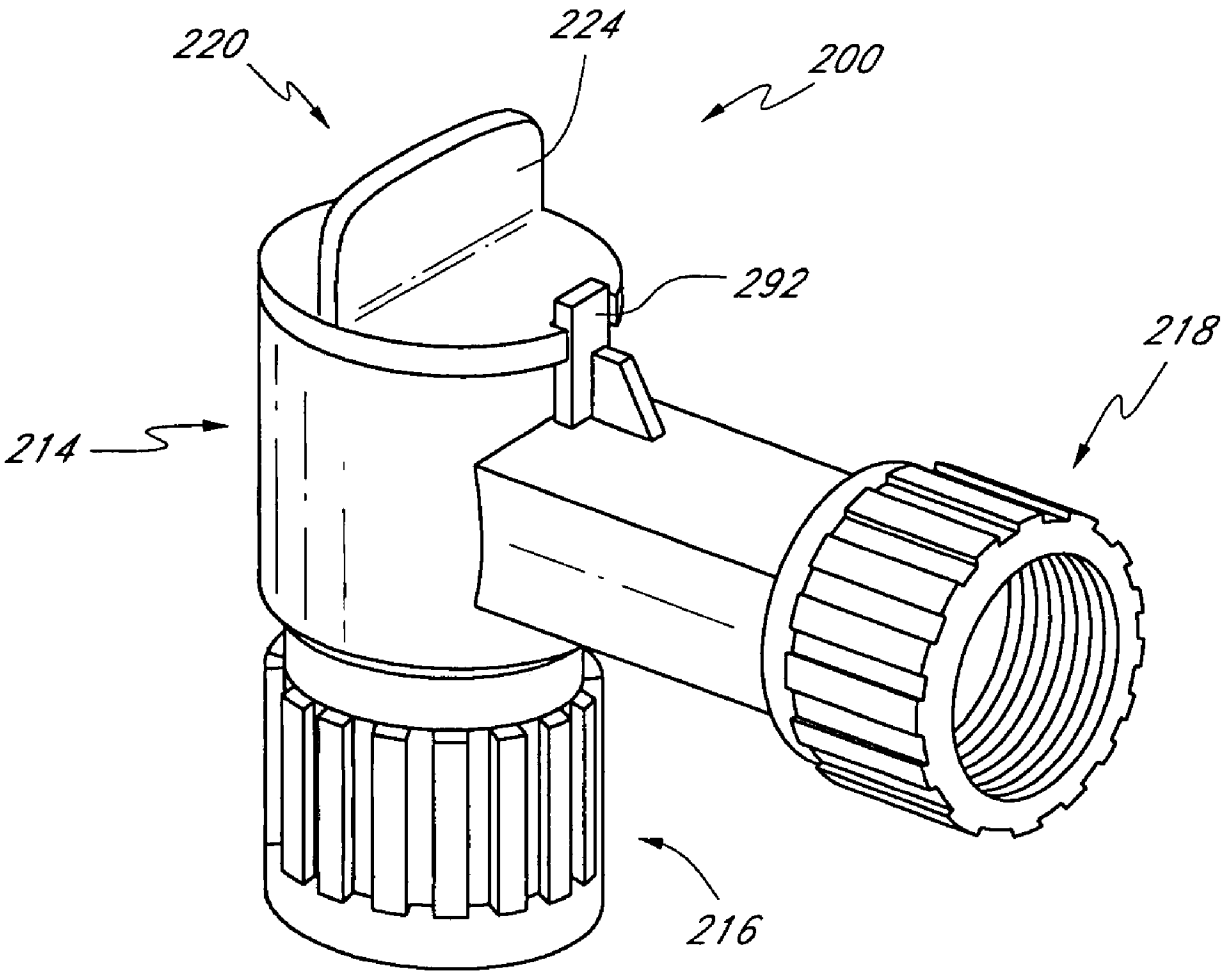
Figure 36:
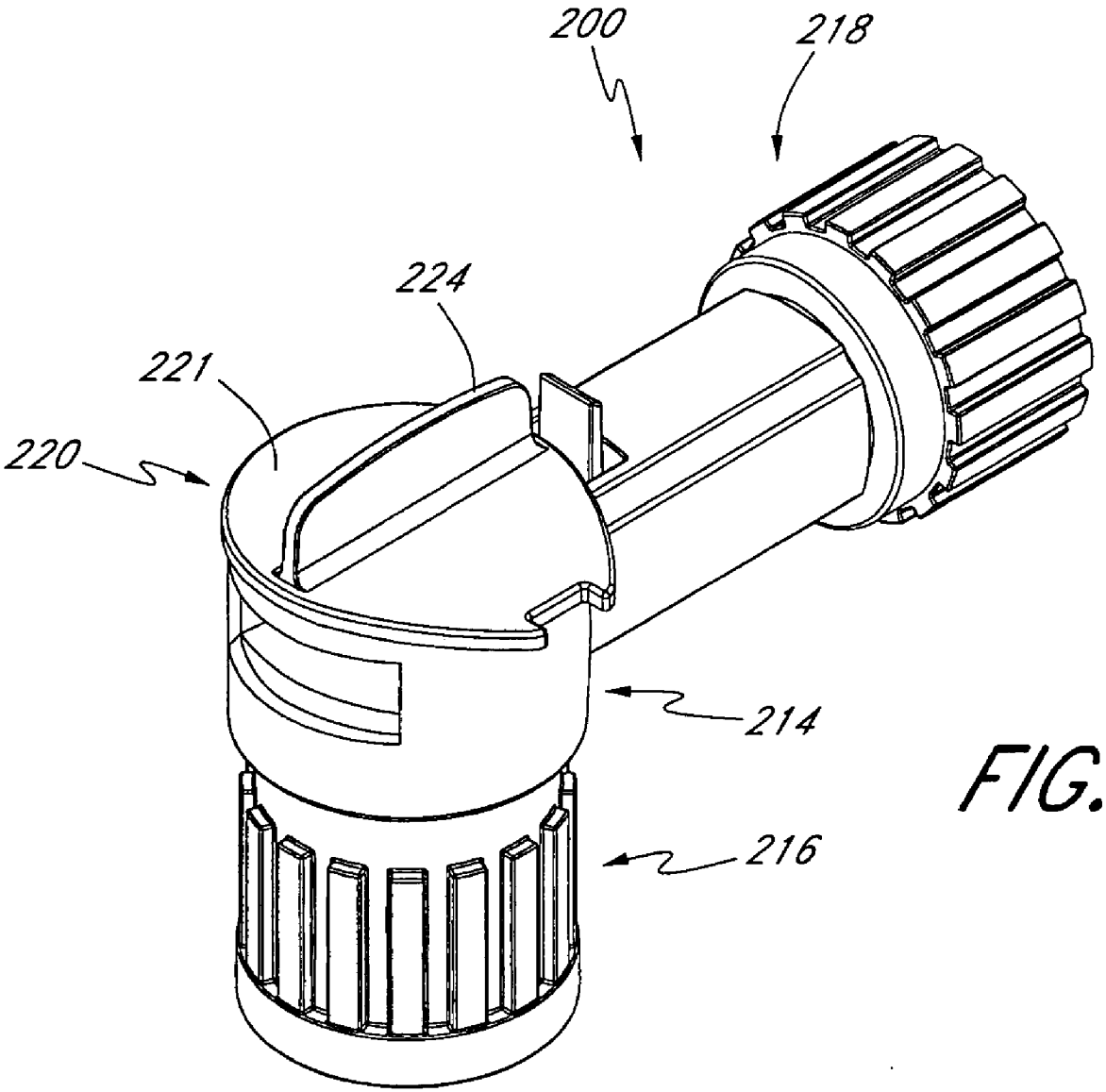
Figure 37:
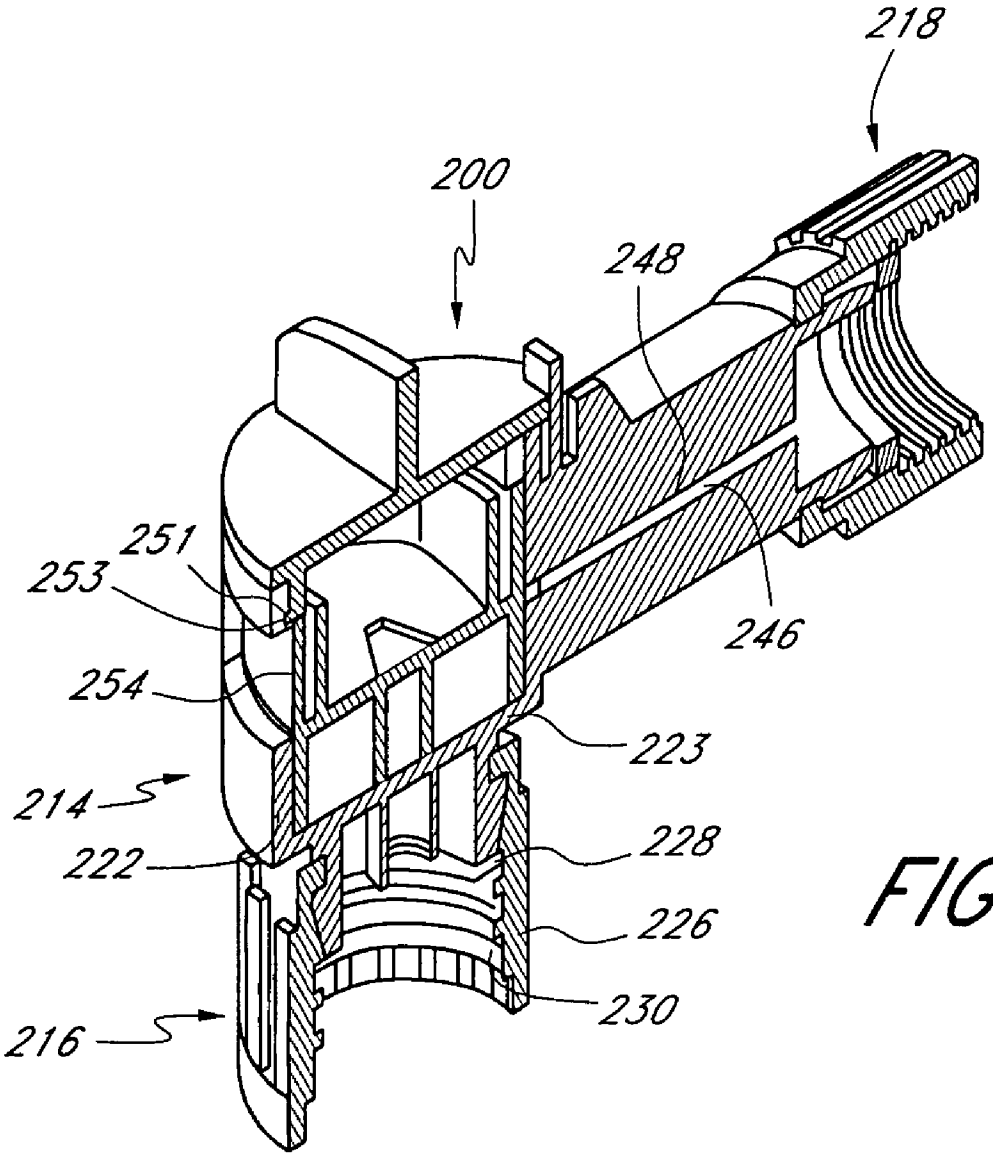
Figure 38:
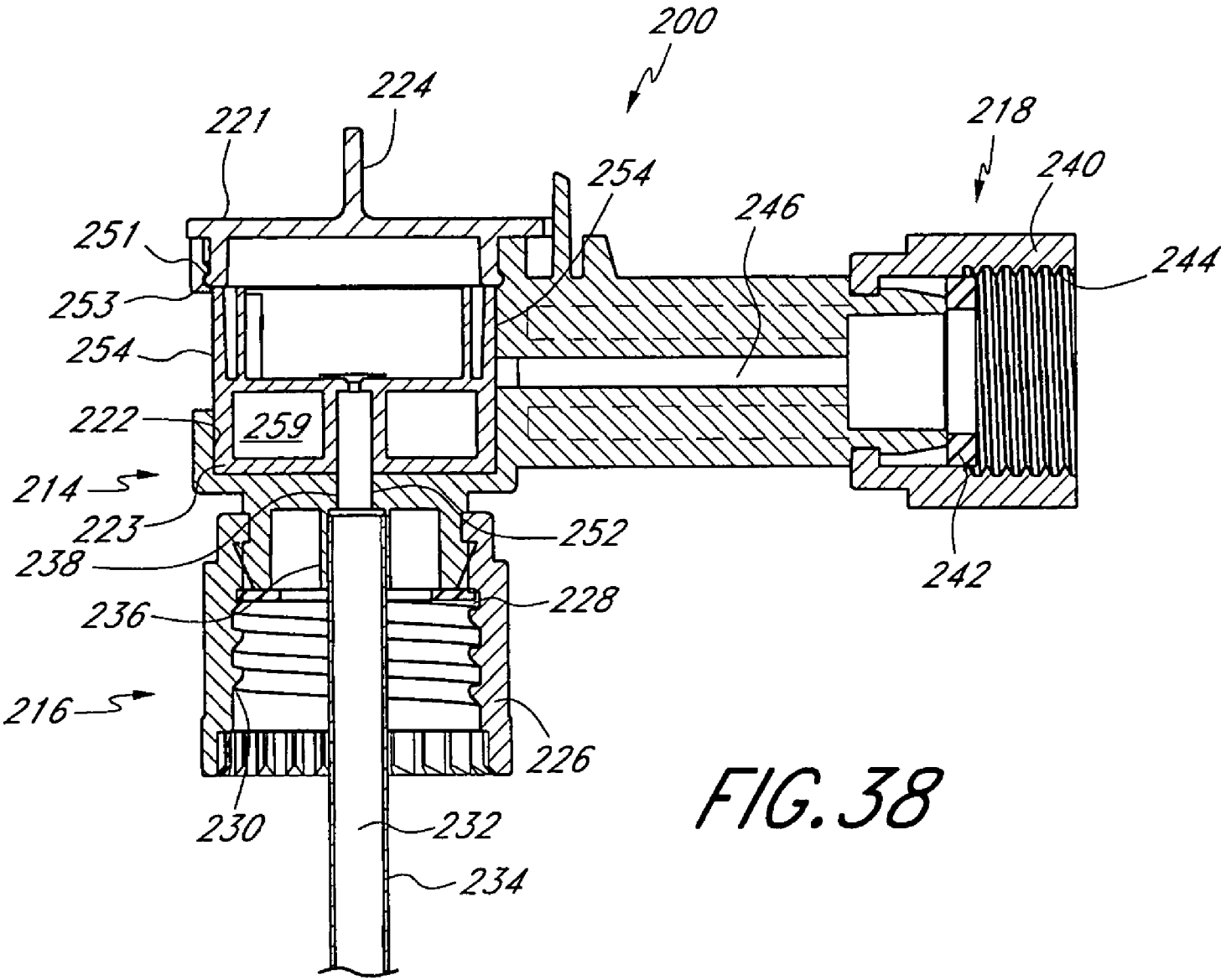
Figure 39:
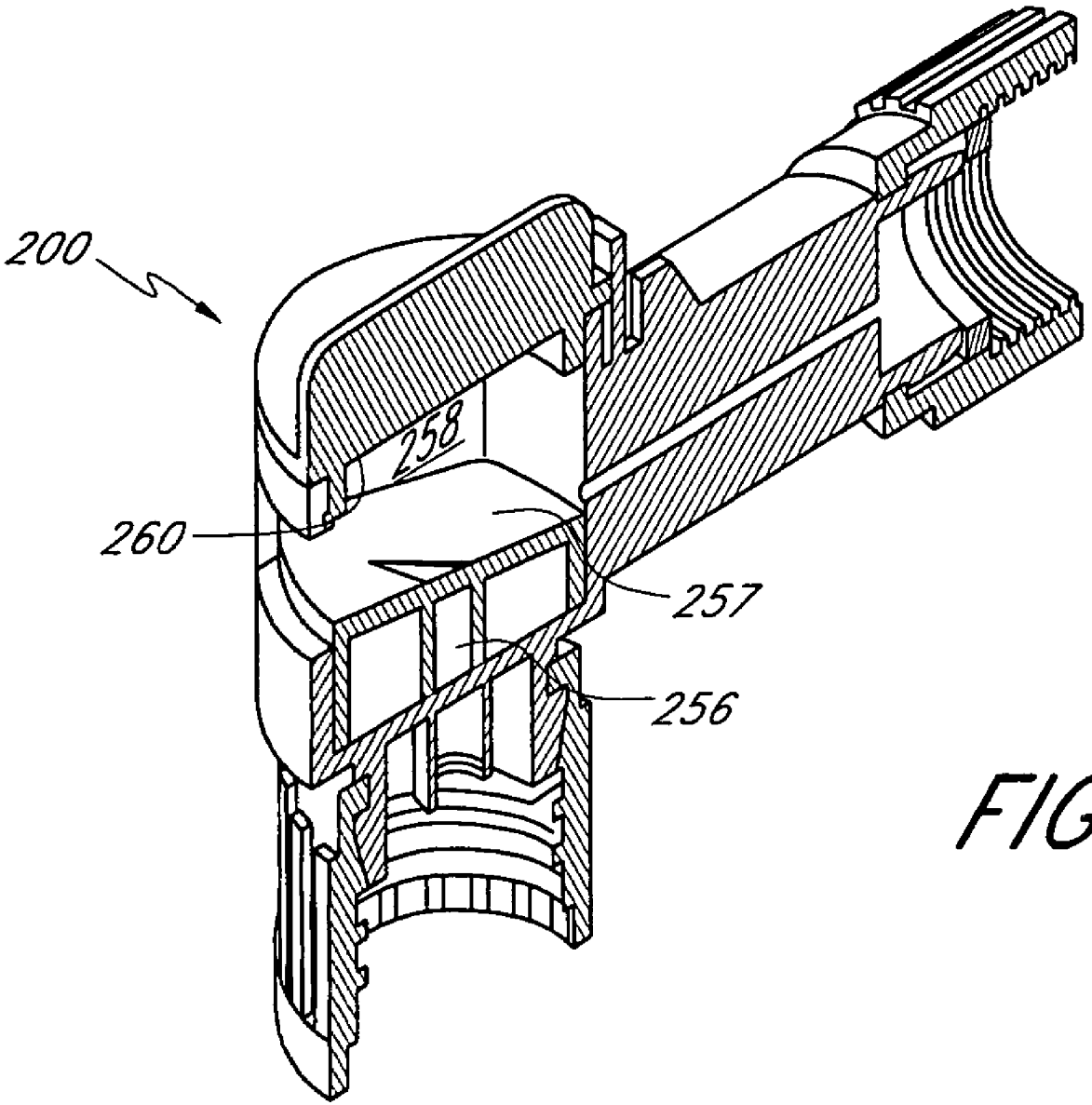
Figure 41B:
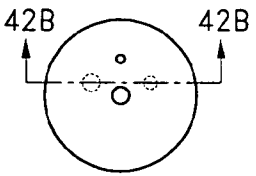
Figure 42B:
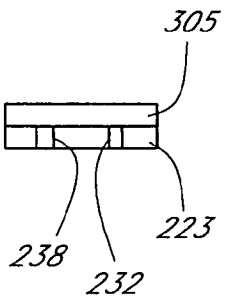
Figure 41A:
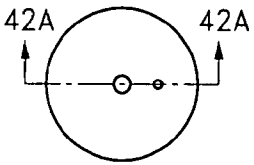
Figure 42A:
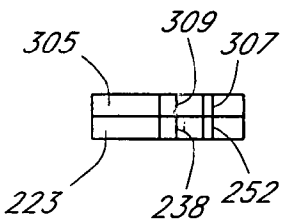
Figure 40:
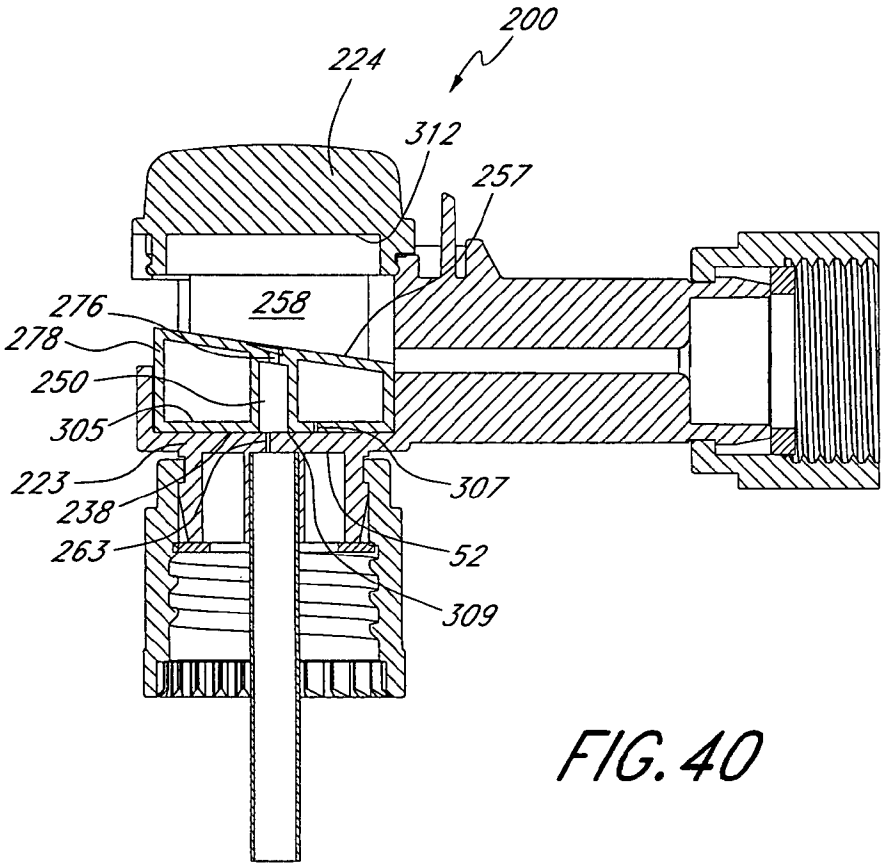

FIG; 23 is a top perspective view of the second component of FIG. 12;

FIG. 24 is a right side view of the second component of FIG. 23;

FIG. 25 is a front view of the second component of FIG. 23;

FIG. 26 is a left side view of the second component of FIG. 23;

FIG. 27 is a rear side view of the second component of FIG. 23;

FIG. 28 is a bottom view of the second component of FIG. 23;

FIG. 28A is a enlarged view of a portion of FIG. 28;

FIG. 29 is a top view of the second component of FIG. 23;

FIG. 29A is a cross-sectional view taken along line 29A-29A of FIG. 29;

FIG. 29B is a enlarged view of a portion of FIG. 29A;

FIG. 29C is a cross-sectional view taken along line 29C-9C of FIG. 29;

FIG. 29D is a enlarged view of a portion of FIG. 29C;

FIG. 30 is a top perspective view of the second sealing member;

FIG. 31 is a top view of the second sealing member of FIG. 30;

FIG. 31A is a cross-sectional view taken through line 31A-31A of FIG. 31;

FIG. 31B is a cross-sectional view taken through line 31B-31B of FIG. 31; and FIG. 31C is a cross-sectional view taken through line 31C-31C of FIG. 31;

FIG. 32 is a top perspective view of the first sealing member;

FIG. 33 is a front view of the sealing member of FIG. 32;

FIG. 33A is a cross-sectional view taken through line 33A-33A of FIG. 33;

FIG. 34 is a front perspective view another embodiment of exemplary sprayer head assembly in an closed position;

FIG. 35 is a rear perspective view of the sprayer head assembly of FIG. 34;

FIG. 36 is a front perspective view of the sprayer head assembly of FIG. 34 in an open position;

FIG. 37 is a cross-sectional perspective view of the sprayer head assembly of FIG. 34 is a closed position;

FIG. 38 is a cross-sectional view of the sprayer head assembly of FIG. 34 is a closed position;

FIG. 39 is a cross-sectional perspective view of the sprayer head assembly of FIG. 36 in an open position;

FIG. 40 is a cross-sectional view of the sprayer head assembly of FIG. 34 is an open position;

FIG. 41A is a top plan view of a bottom wall of a valve of the sprayer head assembly of FIG. 34 in an open position;

FIG. 41B is a top plan view of a bottom wall of a valve of the sprayer head assembly of FIG. 34 in a closed position;

FIG. 42A is a cross-sectional view taken through line 42A-42A of FIG. 41A; and FIG. 42B is a cross-sectional view taken through line 42B-42B of FIG. 41B.

DETAILED DESCRIPTION OF THE PREFERRED EMBODIMENTS

An exemplary sprayer head assembly 10 according a preferred embodiment present invention will be described with initial reference to FIGS. 1-9B. The sprayer head assembly 10 may be connected to a chemical container (not shown). The sprayer head assembly 10 includes a sprayer head 14, a container connection portion 16, a supply fluid connection portion 18, and a rotatable control valve 20. The sprayer head assembly 10 may be made of any suitable material that is resistant to and compatible with the chemical fluid to be sprayed. However, a flexible plastic material, such as polypropylene, is preferred because it is resilient yet durable.

Figure 1:
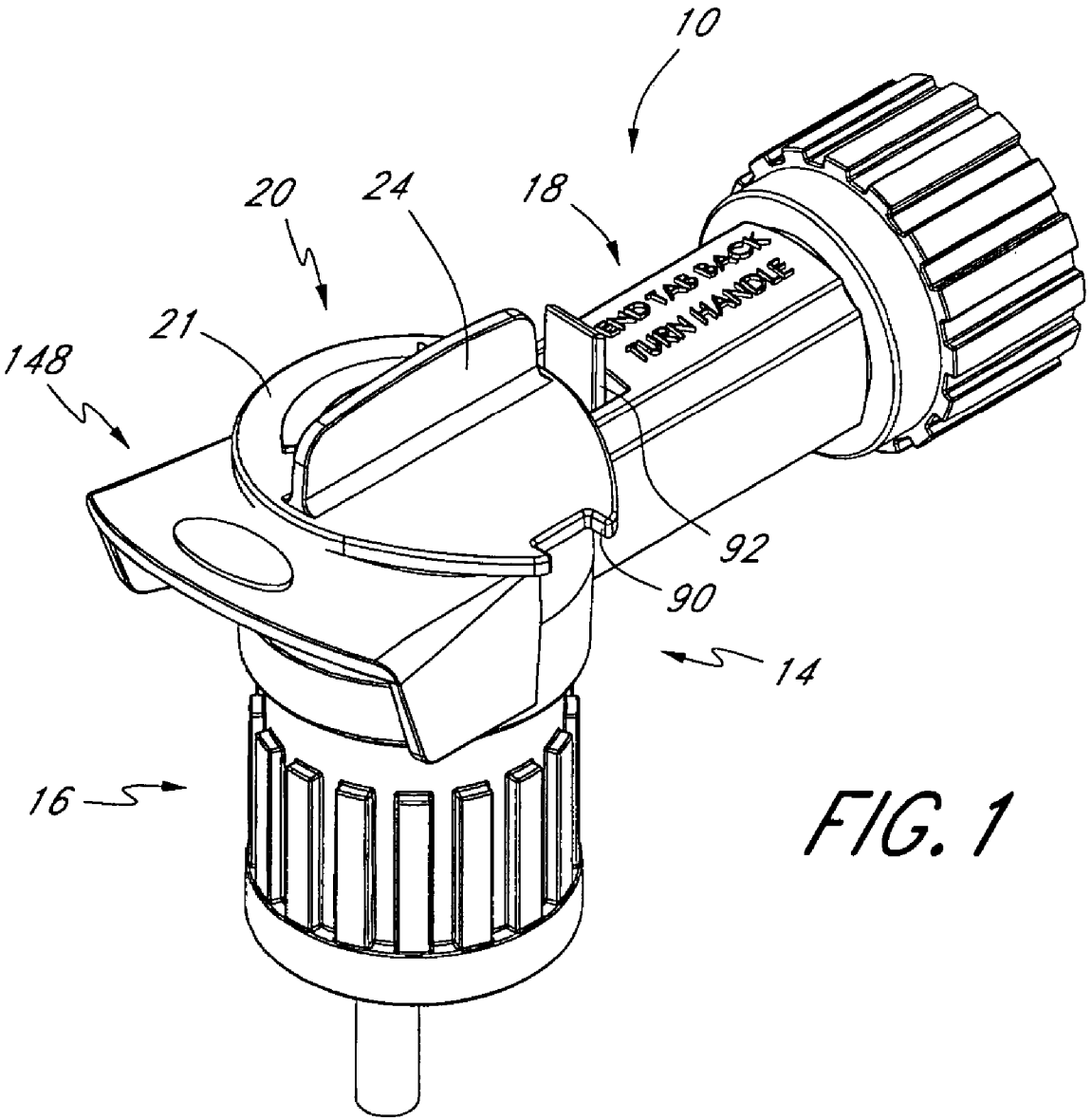
FIG. 1 is a front perspective view an exemplary sprayer head assembly in an open position, the assembly comprising a housing (FIG. 10), a valve (FIG. 12), a first sealing member (FIG. 30) and a second sealing member (FIG. 32)
Figure 3:
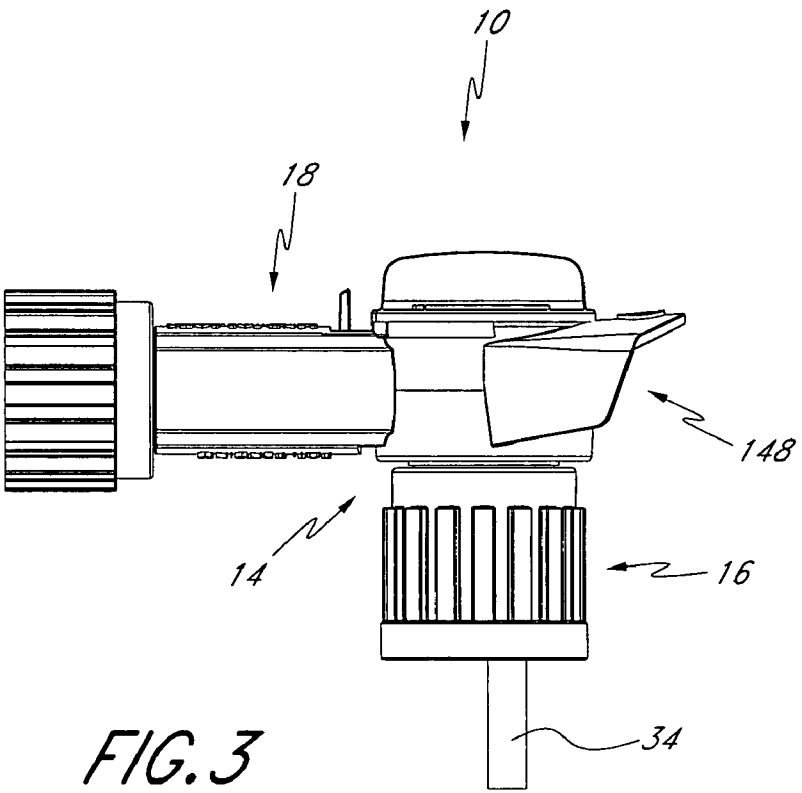
FIG. 3 is a right side view of the sprayer head assembly of FIG. 1.
Figure 2:
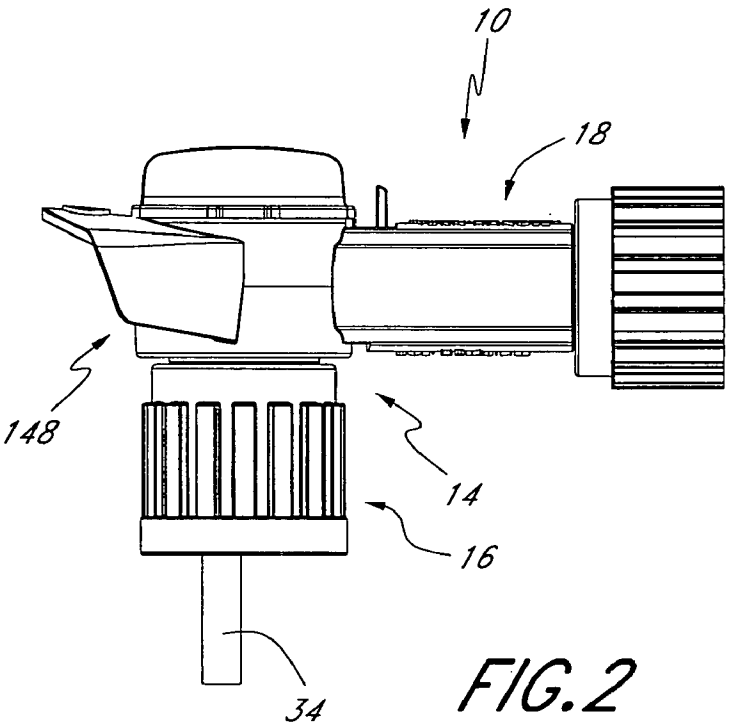
FIG. 2 is a left side view of the sprayer head assembly of FIG. 1.
Figure 8B:
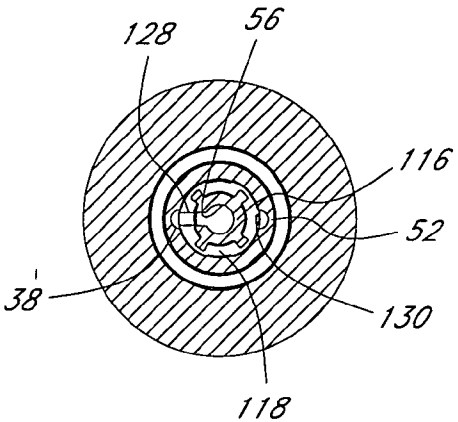
FIG. 8B is a cross-sectional view taken of the along line 8B-8B of FIG. 8A.
Figure 8C:
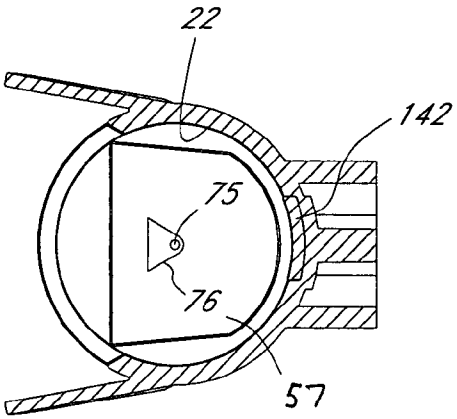
FIG. 8C is a cross-sectional view taken along line 8C-8C of FIG. 8A.
Figure 8A:
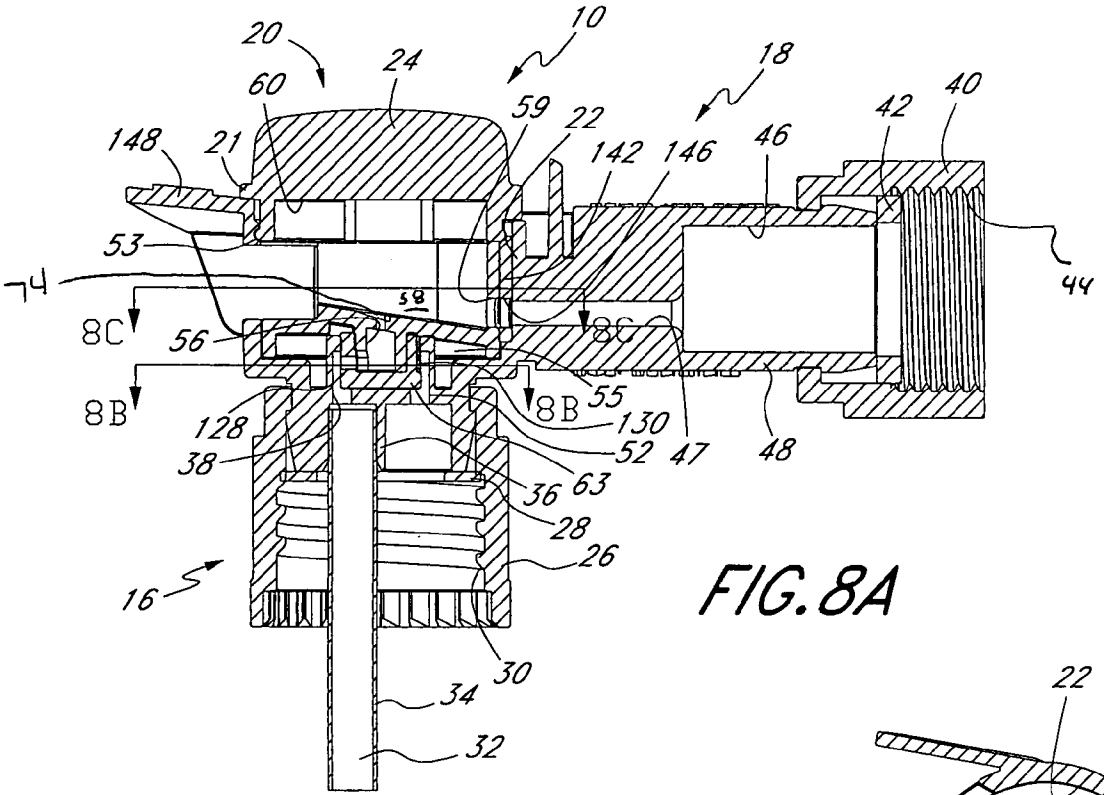
FIG. 8A is a cross-sectional side view of the sprayer head assembly of FIG. 1 taken along line 8A-8A of FIG. 4.
Figure 10:
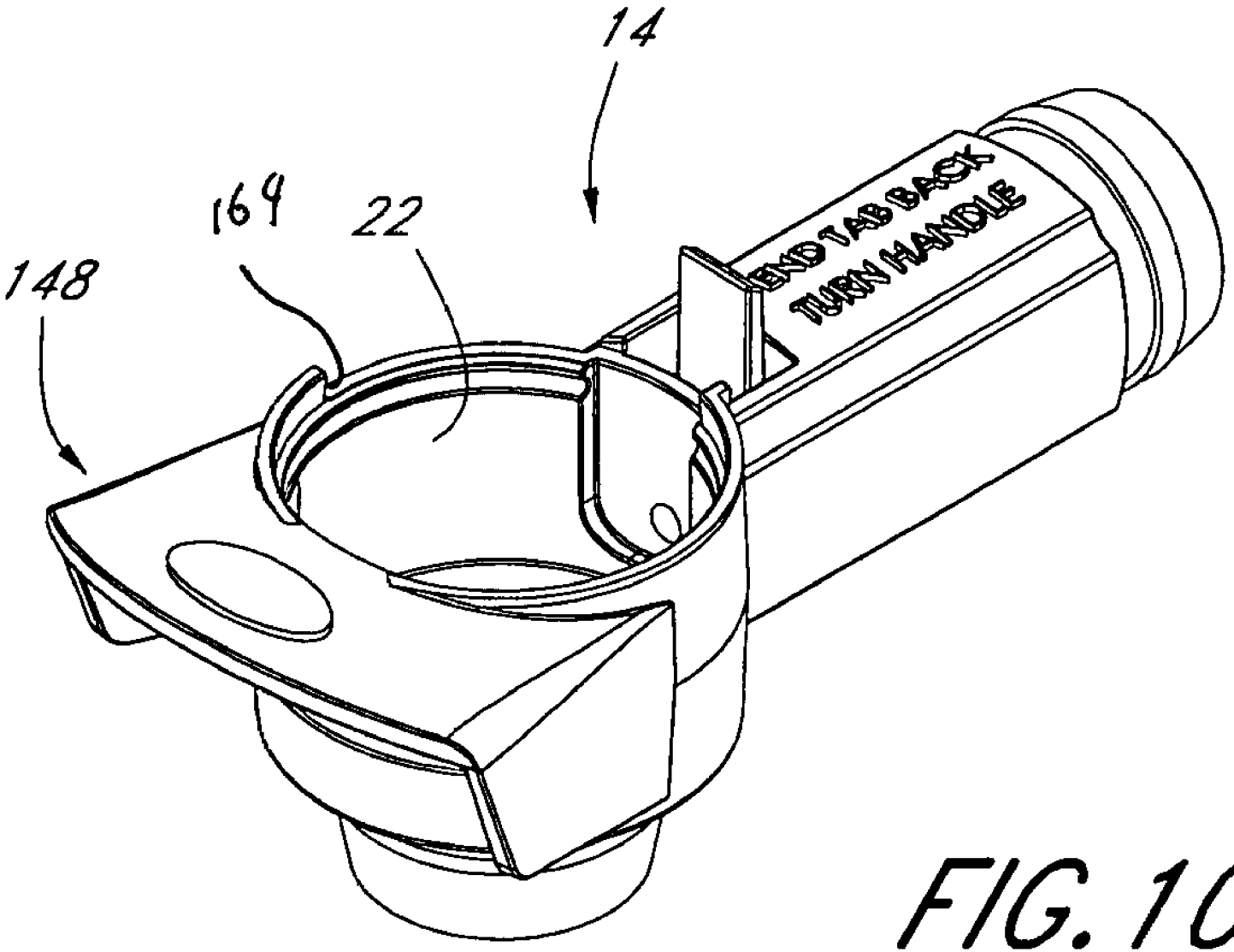
FIG. 10 is a front perspective view of the housing of the sprayer head assembly of FIG. 1.
Figure 11B:
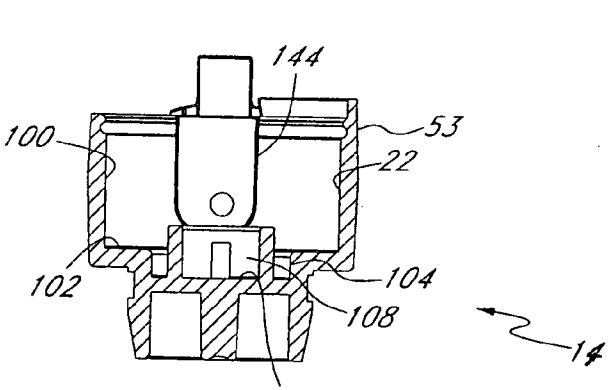
FIG. 11B is a cross-sectional view of the housing taken along line 11B-11B of FIG. 11.

With reference to FIGS. 1, 8A and 8B, the valve 20 is moveably positioned in a generally cylindrical bore 22 that is formed in the sprayer head 14 of the sprayer head assembly 10. FIGS. 10-11C illustrate the sprayer head 14 with the valve 20 removed. As shown, the cylindrical bore 22 is formed, at least in part, by a cylindrical side wall 100 and a horizontal bottom wall 102. A substantially cylindrical counter-bore 104 is formed on the bottom wall 102. A cylindrical flange 106 extends from the bottom of the counter-bore 104 and forms a substantially cylindrical valve stem bore 108 with a bottom wall 110 and side wall 112. With reference back to FIGS. 1, 8A and 8B, the valve 20 includes a gripping area or handle 24 that is mounted onto a valve cap 21. As will be explained in detail below, an operator opens and closes the valve 20 by twisting the handle 24 and rotating the valve 20 about a generally vertically extending axis.

With continued reference to FIGS. 1, 8A and 8B, the connection between the sprayer head assembly 10 and the container can be achieved by providing the container connection portion 16 with a conventional rotatable coupler 26 and a washer 28. The rotatable coupler 26 includes internal threads 30 that cooperate with corresponding threads (not shown) formed on the neck of the container.

The sprayer head assembly 10 can also be permanently attached to the container. In such an arrangement, adhesive can be applied to the inner surface of the connection portion 16 before it is fitted over the neck of the container. Alternatively, the connection portion 16 can include an inwardly projecting ratchet that opposes a cooperating ratchet formed on the container.

When the sprayer head assembly 10 is installed onto the container, the interior of the container is in communication with a chemical passage 32, which as will be explained in more detail below, is also in communication with one or more passages formed in the valve 20 In the illustrated arrangement, the chemical passage 32 is defined, at least in part, in part by a downwardly depending chemical flow tube or dip tube 34. See FIGS. 8A and 8B. The dip tube 34 extends into the container and preferably terminates near a bottom surface of the container. The chemical passage 32 is also defined in part by an internal passage 38, which is in the sprayer head 14. The dip tube 34 is secured in fluid communication with the internal passage 38 by a sleeve 36. Although, in the illustrated arrangement the chemical passage 32 is defined by two components (the dip tube 34 and the internal passage 38), it should be appreciated that the chemical passage 32 can be defined by a single component or more than two components. The illustrated arrangement, however, is preferred because it is easy to manufacture and yet uses a small number of components.

Figure 11A:
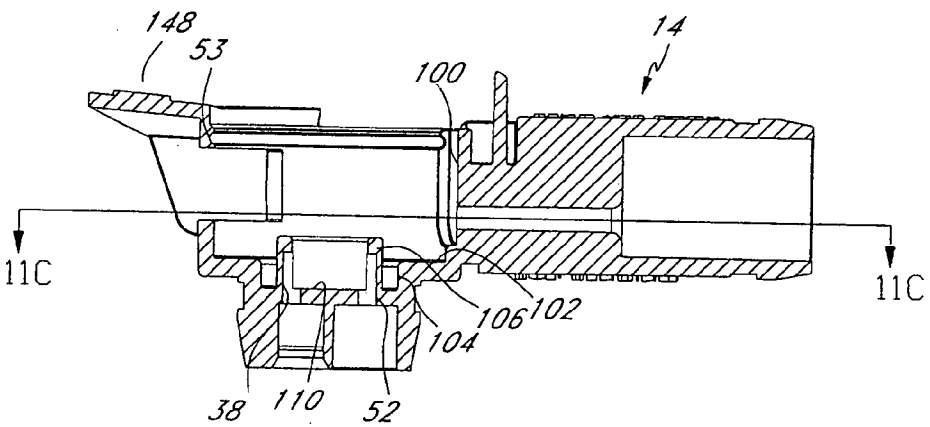
FIG. 11A is a cross-sectional view of the housing taken along line 11A-11A of FIG. 11.
Figure 11:
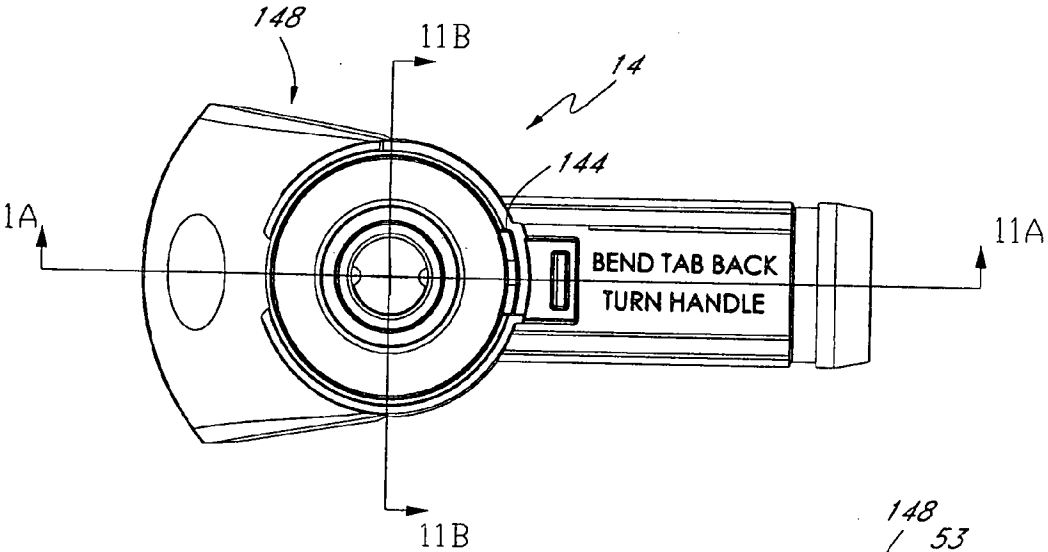
FIG. 11 is a top view of the housing of FIG. 10.
Figure 11C:
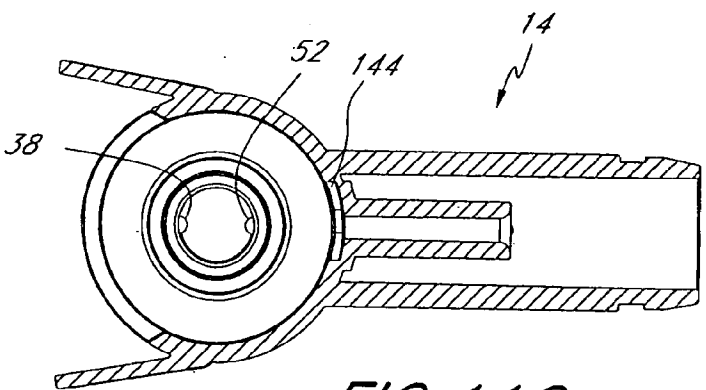
FIG. 11C is a cross-sectional view of the housing taken along line 11C-11C of FIG. 11.
Figure 14:
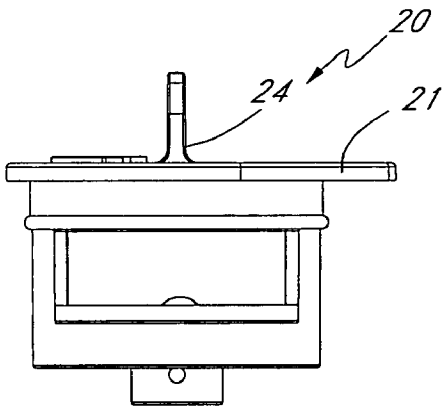
FIG. 14 is a front view of the valve of FIG. 12.
Figure 16:
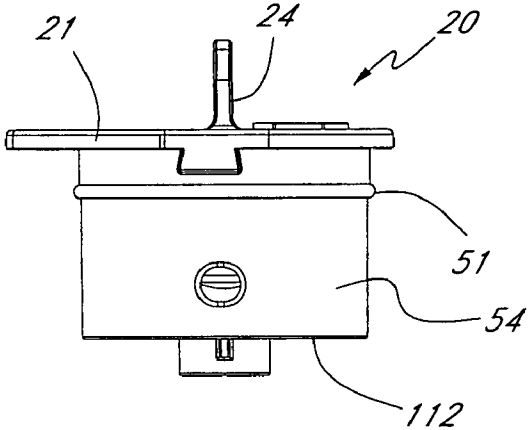
FIG. 16 is a rear view of the valve of FIG. 12.
Figure 13:
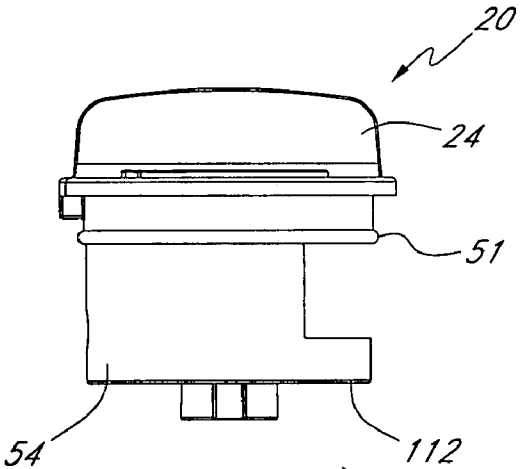
FIG. 13 is a right side view of the valve of FIG. 12.
Figure 15:
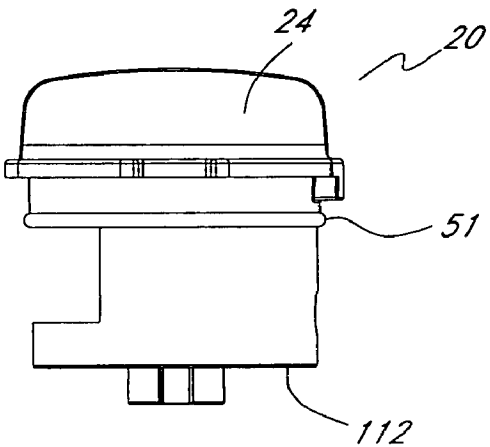
FIG. 15 is a left side view of the valve of FIG. 12.

Preferably, the sprayer head assembly 10 includes a vent passage 52, which is shown in FIGS. 8A, 8B and 11A. In the illustrated arrangement, the vent passage 52 is formed in the head 14 of the assembly 10. As with the chemical passage 32, the vent passage 52 communicates with the interior of the container when the assembly 10 is mounted onto the container. The vent passage 52 extends up through head 14 and the flange 106 and communicates with the interior of the valve stem bore 108. In the illustrated embodiment, the vent passage 52 lies generally parallel to (and spaced along the axis of the valve from) the interior passage 38. Although, in the illustrated arrangement the vent passage 52 is formed on the assembly 10, it should be appreciated that a vent passage can be located on the container. However, the illustrated arrangement is preferred because, as will be explained below, it facilitates the opening and closing of the vent passage 52 along with the chemical passage 32.

Figure 9:
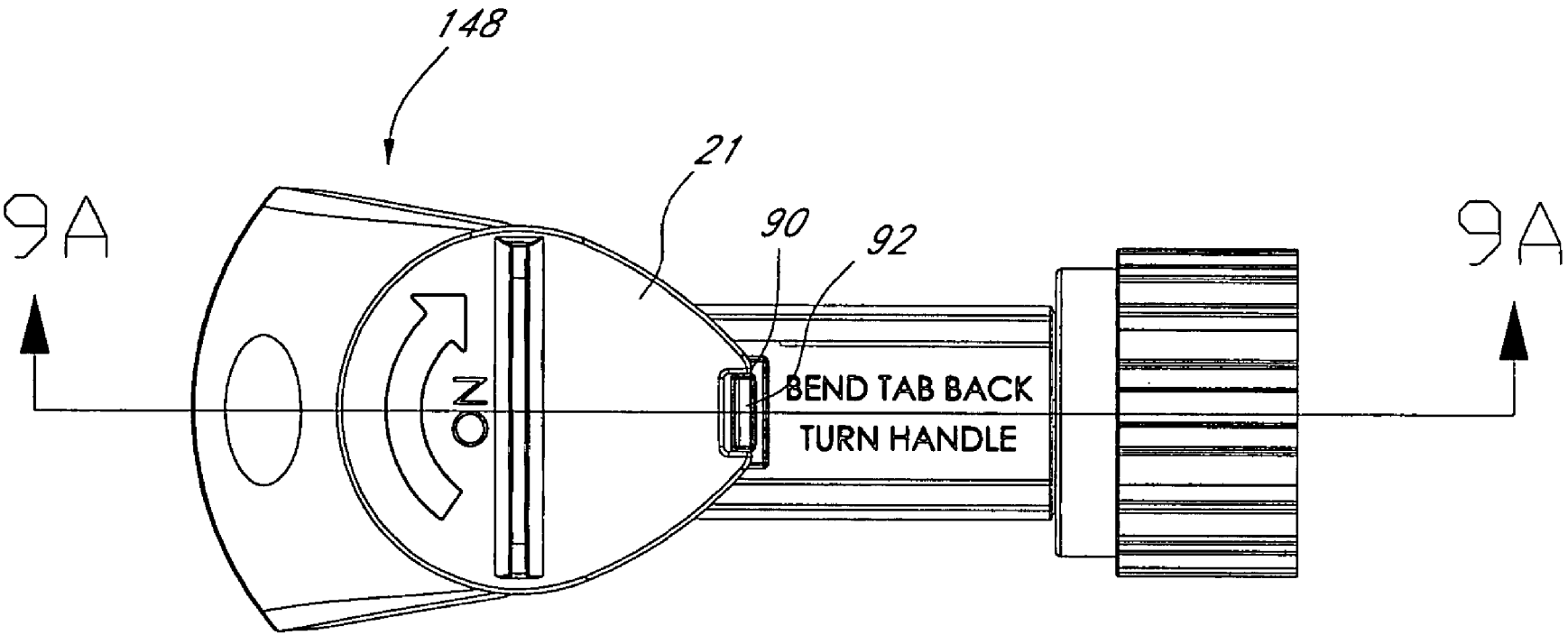
FIG. 9 is a top view the sprayer head assembly of FIG. 1 in a closed position.
Figure 9B:
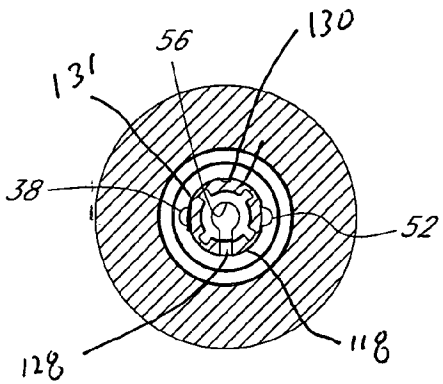
FIG. 9B is a cross-sectional view taken along line 9B-9B of FIG. 9A.
Figure 9A:
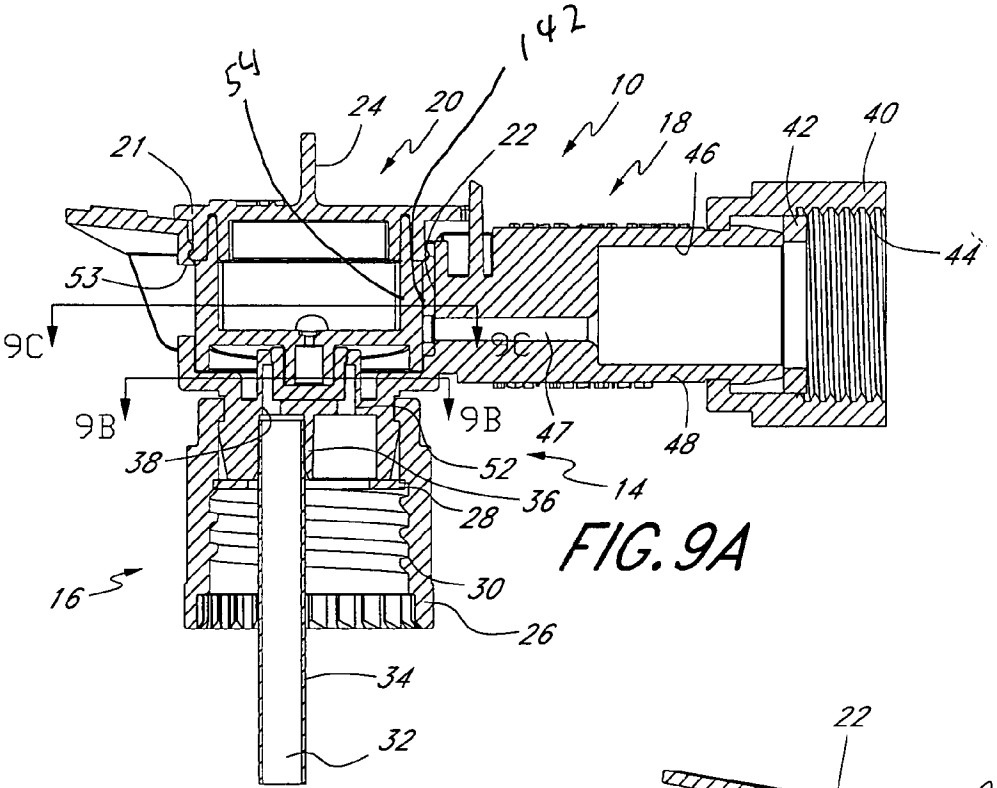
FIG. 9A is a cross-sectional side view taken along line 9A-9A of FIG. 9.
Figure 9C:
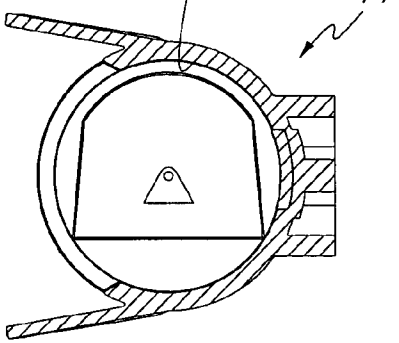
FIG. 9C is a cross-sectional view taken along line 9C-9C of FIG. 9A.

As mentioned above, the sprayer head assembly 10 also includes a supply fluid connection portion 18 (see FIGS. 8A and 9A). The supply fluid connection portion 18 connects the assembly to a pressurized supply fluid source (not shown), such as, for example, a garden hose. In the illustrated arrangement, the connection is formed by a conventional rotatable coupler 40 and a washer 42. The coupler 40 includes threads 44 that cooperate with corresponding threads (not shown) formed on the supply fluid source. One of ordinary skill in the art will appreciate that other configurations can be used to connect the assembly 10 to the supply fluid source.

With continued reference to FIGS. 8A and 9A, the fluid connection portion 18, defines, in part, a supply passage 46. The supply passage 46 places the supply fluid source in communication with the interior of the bore 22. In the illustrated arrangement, the supply passage 46 is defined in part by a side wall 48 of the sprayer head 14. The side wall 48 extends from the coupler 40 towards the cylindrical bore 22. The supply passage 46 may include a narrowing portion 47 for controlling the flow rate of the fluid flowing through the sprayer 10.

The valve 20 will now be described in more detail. FIGS. 12-18B include perspective, right side, front, left side, rear, bottom, top and cross-sectional views of the valve 20. In the illustrated embodiment, the valve 20 includes a generally cylindrical wall 54 that defines a cylindrical periphery for sliding engagement with the cylindrical bore 22. Preferably, the outer wall 54 near the handle 24 includes an annular protrusion 51 that is configured to engage an annular groove 53 (see FIG. 11B) formed along the interior wall of the cylindrical bore 22. Accordingly, the valve 20 may be inserted into the sprayer head 14 by snap-fitting annular ridge 51 into the annular groove 53 (see FIGS. 8A and 9A) Once snap-fitted, the valve 20 may rotate within the cylindrical bore 22 but is secured axially by the engagement of the ridge 51 with the annular groove 53. As mentioned above, the bore 22 is closed at one end by a bottom wall 102 that is preferably integrated with the assembly head 14. The bore 22 is closed at the other end by the valve cap 21. The valve 20 includes a lower wall 113 located generally opposite the handle 24 and the valve cap 21. An annular flange 112 extends downwardly around the periphery of the lower wall 113.

Figure 18:
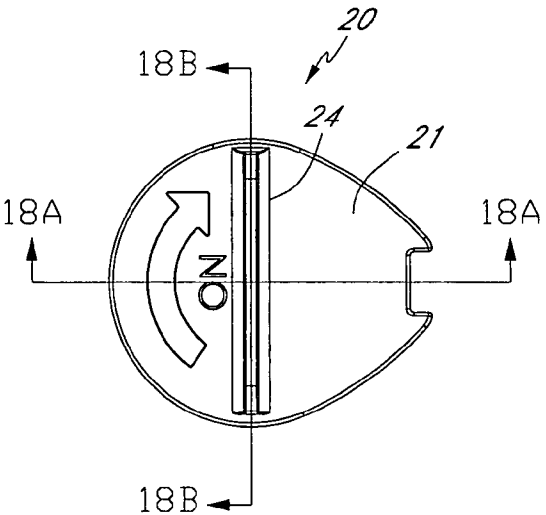
FIG. 18 is a top view of the valve of FIG. 12.
Figure 18B:
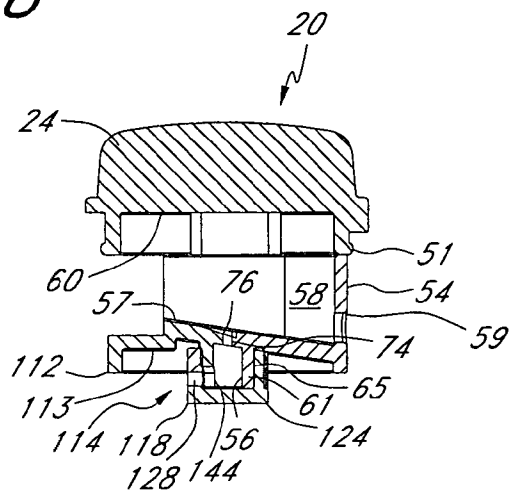
FIG. 18B is cross-sectional view taken through line 18B-18B of FIG. 18.
Figure 17:
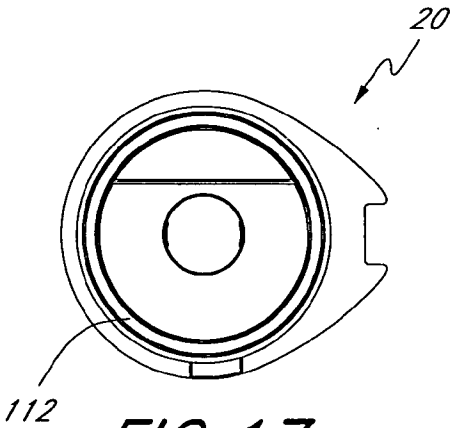
FIG. 17 is a bottom view of the valve of FIG. 12.
Figure 18A:
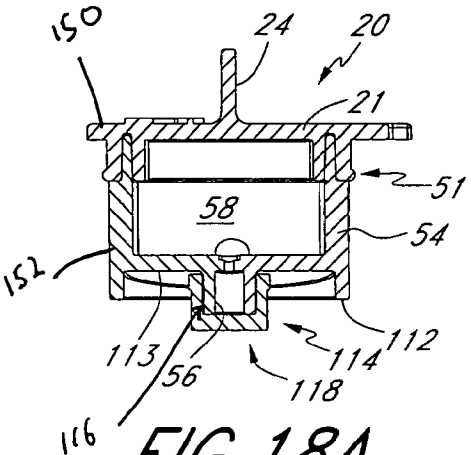
FIG. 18A is cross-sectional view taken through line 18A-18A of FIG. 18.

In the illustrated embodiment, the valve 20 also includes a valve stem 114 (shown with a sealing member 118 described below), which extends downwardly from the lower surface 112. With particular reference to FIGS. 18A and 18B, the valve stem 114 comprises annular flange 116 that extends from the lower wall 113 and a sealing member 118 that surrounds the annular flange 116.

The sealing member 118 is shown in detail in FIGS. 30-31C. As shown, the sealing member 118 includes a generally cylindrical wall 120 that forms a generally cylindrical outer surface 121 and generally cylindrical inner bore 122 that is closed at one end by a bottom wall 124 that forms a lower surface 123 of the sealing member 118. The inner bore 122 includes a plurality of longitudinally extending grooves 126 that are spaced about the periphery of the bore 122.

With particular reference to FIGS. 30 and 31A, a chemical transition passage 128 is formed in the wall of the sealing member 118. The transition passage 128 extends from the outer surface 121 of the cylindrical wall 120 to the inner bore 122. As will be explained in more detail below, the transition passage 128 places the chemical passage 32 in communication with passages in the valve 20 when the valve 20 is in an open position. With continued reference to FIGS. 30 and 31A., the sealing member 118 also includes a vent channel or groove 130, which is formed on the outer surface 121 of the sealing member 118 and extends to the lower surface 123. As will be described in more detail below, the vent channel 130 places the vent passage 52 in communication with an atmospheric pressure source when the valve 20 is an open position.

FIGS. 27, 28 and 28A illustrate the annular flange 116 of the valve stem 114 in more detail. As shown, in the illustrated embodiment, the annular flange 116 includes a generally cylindrical wall 132 that forms an inner bore 134 and an outer surface 136. The outer surface 136 includes a plurality of longitudinal protrusions 138. The cylindrical wall 132 and protrusions 138 are configured such that the sealing member 118 may be fitted over and anti-rotationally coupled to the annular flange 116. The sealing member 118 and annular flange 16 may be dimensioned such that they are coupled together via an interference or friction fit. In other embodiments, adhesive may also be used to couple the two components together. With particular reference to FIG. 28A, a chemical channel 144 extends from the outer surface 136 to the inner bore 134.

As will be explained below, the valve 20 controls the flow of chemical through the assembly 10. The valve 20 also preferably controls the flow of supply fluid through the assembly 10. More preferably, the valve 20 also controls the communication of the vent passage 52 with atmospheric pressure.

With reference back to FIGS. 18A and 18B, the valve stem 114 defines at least in part a first valve passage 56. In the illustrated embodiment, the passage 56 defined in part by the inner bore 134 of the annular flange 116, the bottom wall 124 of the sealing member 118, the chemical channel 144, and the chemical transition passage 128.

As seen in FIG. 29B, the first valve passage 56 preferably communicates with an generally cylindrical metering orifice 74 that preferably terminates within a graduated suction generating recess 76, which is formed on a suction generating surface 57. Preferably, the valve 20 defines the metering orifice 74, the suction generating recess 76 and the suction generating surface 57. However, it should be appreciated that in other embodiments, the metering orifice 74, the suction generating recess 76 and/or the suction generating surface 57 may not be defined by the valve 20. The illustrated arrangement is preferred because, as will be explained in more detail below, the metering orifice 74 can be more accurately manufactured.

The diameter of the metering orifice 74 determines, for the most part, the dilution ratio of the sprayer head assembly 10. The method for determining the diameter of the metering orifice to achieve a desired dilution ratio are well known to those of ordinary skill in the art; therefore, a detailed description of such a method is not necessary.

As seen in FIGS. 29 and 29B, the suction generating surface 57 defines the graduated suction generating recess 76. The recess 76 has a generally triangular shape that is formed by two side walls and a rounded end wall. A mouth 75 of the metering orifice 74 lies on a lower face of the recess 76 near the rounded end wall. The recess 76 is deepest at the apex where the mouth 75 of the metering orifice 74 is located. The graduated suction generating recess 76 is sized and configured, as is well known in the art, so that when carrier fluid flows over the 76 recess a suction force is created. The suction force draws the chemical from the container through the chemical passage 32. Of course, one of ordinary skill in the art will recognize that the desired suction force can be created with graduated suction generating recesses of other shapes and sizes and in some embodiments without a suction generating recess.

With reference back to FIG. 18B, the valve 20 also defines, at least partially, a second passage 58 that is aligned with the supply passage 46 (see FIG. 8A) when the valve 20 is in the open position. In the illustrated embodiment, the second passage 58 is defined at least in part by an opening 59 in the cylindrical wall 54, the suction generating surface 57 and a top wall 60 defined by the valve 20. In modified embodiments, the second passage 58 may be formed in part by the sprayer head 14 and, in particular, portions of the inner bore 22.

With reference to FIGS. 8A and 8B, in the open position, the sealing member 118 forms a seal between the internal passage 38 and the first passage 56. Accordingly, the connection between the internal passage 38 and the first passage 56 is sealed and chemical is prevented from leaking into the gaps between the valve 20 and the valve stem bore 108. In the illustrated embodiment, the sealing member 118 is formed from a separate single component that is positioned over the annular flange 116 and moves with the valve 20. The sealing member 118 is preferably made of a soft plastic elastomer material or other suitable synthetic rubber material. Such material provides an effective seal with the valve stem bore 108, which as mentioned above is preferably made of a harder plastic material that forms the sprayer head 14. In another embodiment, a sealing member maybe positioned within a recess or along the inner surface of the valve stem bore 108. In other embodiments, the annular flange 116 and/or the valve stem bore 108 may be integrally formed with or coated with an elastomer, rubber or rubber like material to form a tight seal.

With continued reference to FIGS. 8A and 8B, in the open position, the vent passage 52 is in communication with the vent channel 130. The vent channel 130, in turn, places the vent passage 52 in communication with spaces 55 in the valve 20. Because of gaps between the valve 20 and the inner bore 22, the vent passage 52 is therefore in communication with a atmospheric pressure source.

In the open position, the opening 59 of the valve 20 is aligned with the supply passage 46 such that pressurized fluid may flow into the second passage 58. A shown in FIGS. 8A and 8C, a second sealing member 142 may be positioned between valve 20 and the inner bore 22 so as to provide a seal between the second passage 58 and the supply passage 46 in the open position. The second sealing member 142, which is also shown in more detail in FIGS. 32-33A, may be positioned within a recess 144 formed on the inner bore 22 (see also FIGS. 11-11C). The second sealing member 142 includes a supply fluid transition passage 146, which, in the open position, is aligned with the second passage 58 and the supply fluid passage 46. As with the first sealing member 118, the second sealing member 142 may be formed from any of a variety of elastic materials (e.g., elastomer, rubber or rubber like materials).

In the illustrated embodiment, the first and second sealing members 118, 142 provide a seal between the passages in the sprayer head 14 and the passages in the valve 20. However, those of skill in the art will recognize in light of the description herein that in modified embodiments the valve 20 and/or the inner bore 22 may be provided with any of a variety of combinations of sealing members, coatings and/or integrally formed pieces that are configured to provide a seal between the passages in the sprayer head 14 and the valve 20. Such sealing members, coatings and/or integrally formed pieces maybe formed on and/or in the valve 20 and/or sprayer head 14.

With continued reference to FIG. 8A, in operation when the valve 20 is in the open position, a stream of pressurized carrier fluid is discharged into the second passage 58 from the supply passage 46. As the carrier fluid flows over the suction generating surface 57, a suction force is created that draws chemical through the dip tube 34, internal passage 38, THE first passage 56, and the metering orifice 74 and into the stream of carrier fluid. The upwardly inclined orientation of the suction generating surface 57 helps to generate the suction force. Venting is provided through the vent passage 52 and vent channel 130.

Preferably, the chemical and carrier fluid is directly discharged from the assembly 10 through the second passage 58. In the illustrated embodiment, a hood 148 (see also FIGS. 1-6) extends from the sprayer head 14 and the second passage 58. It should be appreciated that the hood 148 is not necessary to practice the present invention. However, the hood 148 is preferred because it protects the operator from water and chemical splatter. It should also be appreciated that an additional outlet nozzle or deflector could be added to the assembly 10 to further direct the water and chemical flow. Such a nozzle can extend from the second passage 58 and would offer additional control of the carrier fluid and chemical stream. One of ordinary skill in the art will recognize that the second passage 58 may have a diverging or modified shape to promote a certain spray pattern. The illustrated arrangement is preferred, however, because it reduces the size of the assembly 10 and the number of components and yet still produces an effective spray pattern.

When the valve is rotated to the closed position (see e.g., FIG. 9A), the carrier passage 46 is closed by the valve 20. In this position, the wall 54 of the valve 20 covers the carrier fluid passage 46. As discussed above, inner bore 22 and/or the valve 20 may be configured in a variety of ways to provide a tight seal between the valve 20 and the carrier fluid passage 46. In the illustrated embodiment, the second sealing member 142 provides a seal between the valve 20 and the carrier fluid passage 46 reducing or preventing leakage past the valve 20. In addition, the valve 20 is preferably configured to block the chemical passage 32 and/or the vent passage 52 in the closed position. With continued reference to FIG. 9B, in the illustrated embodiment, the first sealing member 118 rotates with the valve 20 within the valve stem bore 108. In the closed position, the chemical transition passage 128 and the vent channel 130 are no longer in communication with the internal passage 38 and the vent passage 52. Instead, the outer surface 131 of the first sealing member 118 forms a tight seal over the internal passage 38 and the vent passage 52. In this manner, in the closed position, leakage of the chemical into the valve stem bore 108 is reduced or eliminated.

Figure 4:
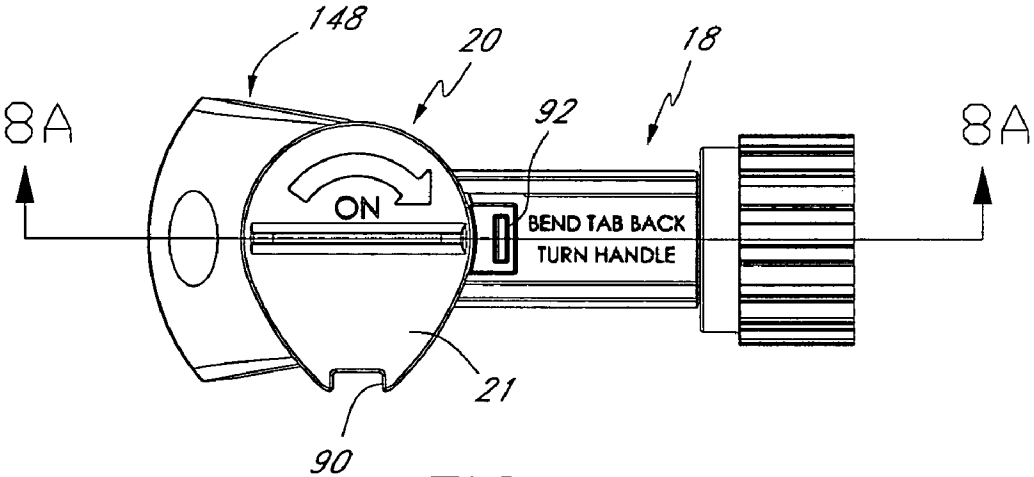
FIG. 4 is a top view the sprayer head assembly of FIG. 1.
Figure 5:
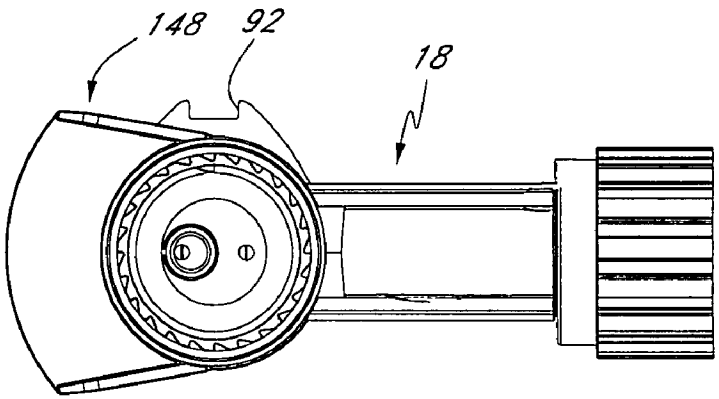
FIG. 5 is a bottom view of the sprayer head assembly of FIG. 1.
Figure 7:
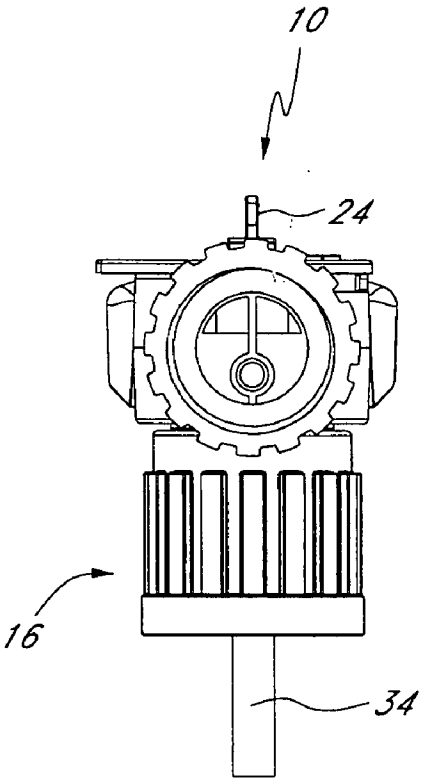
FIG. 7 is a rear view of the sprayer head assembly of FIG. 1.
Figure 6:
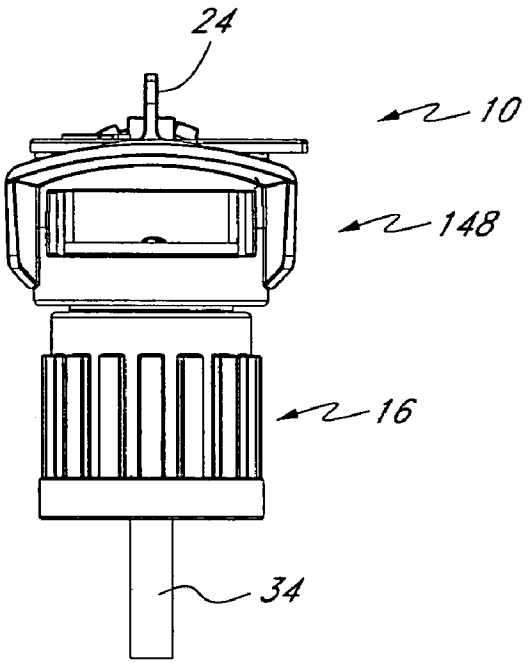
FIG. 6 is a front view of the sprayer head assembly of FIG. 1.

The valve 20 preferably can be conveniently operated with one hand while the assembly 10, container 12, and a hose connected to assembly 10 can be controlled with the other hand thereby providing a safe spray operation. The assembly 10 also preferably includes child-proofing features. For example, as shown in FIGS. 1, 4 and 9, a tab 92 extends from the connection portion 18 and engages an indentation 90 formed on the valve cap 21. When the valve 20 is in the closed position (FIG. 9), the tab 92 engages the indentation 90 and secures the valve in the closed position. Therefore, to open the valve 20, the operator must simultaneously bend back the tab 92 and rotate the valve 20. This requires a level of strength and dexterity that is typically not possessed by children.

The illustrated assembly 10 described above is particularly adapted to be manufactured by injection molding. Because the assembly 10 will typically be discarded after the chemical in the container is exhausted, the costs of manufacturing the assembly 10 must be low. Injection molding is a particularly low cost method of making parts out of plastic-type materials. Those of ordinary skill in the art will recognize that the sprayer head 14, the container connection portion 16, the supply fluid connection portion 18, the sealing member and the rotatable control valve 20 can all be formed using injection molding.

In order to further facilitate forming the sprayer head from injection molding, the valve 20 may be formed from a plurality of components. For example, as shown in FIG. 18A, in the illustrated embodiment, the valve 20 is formed from a first component 150 and a second component. 152.

Figure 20A:
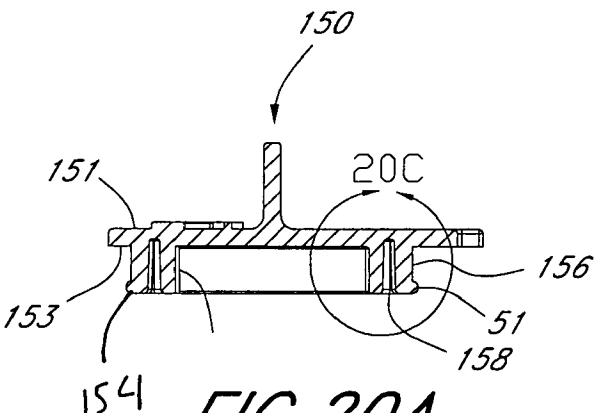
FIG. 20A is a cross-sectional view of the first component taken along line 20A-20A of FIG. 20.
Figure 20C:
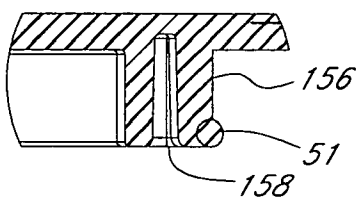
FIG. 20C is an enlarged view of a portion of FIG. 20A.
Figure 20B:
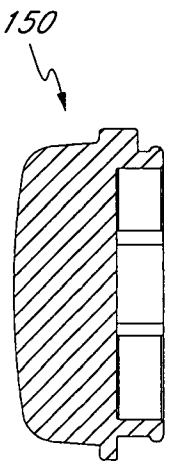
FIG. 20B is a cross-sectional view of the first component taken along line 20B-20B of FIG. 20.
Figure 19:
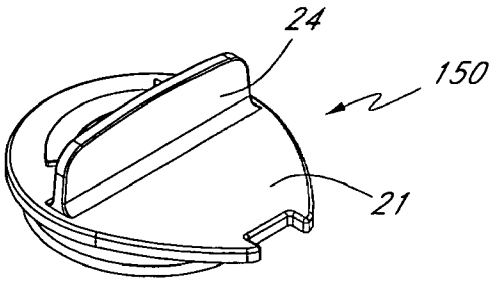
FIG. 19 is a top perspective view of the first component of the valve of FIG. 12.
Figure 20:
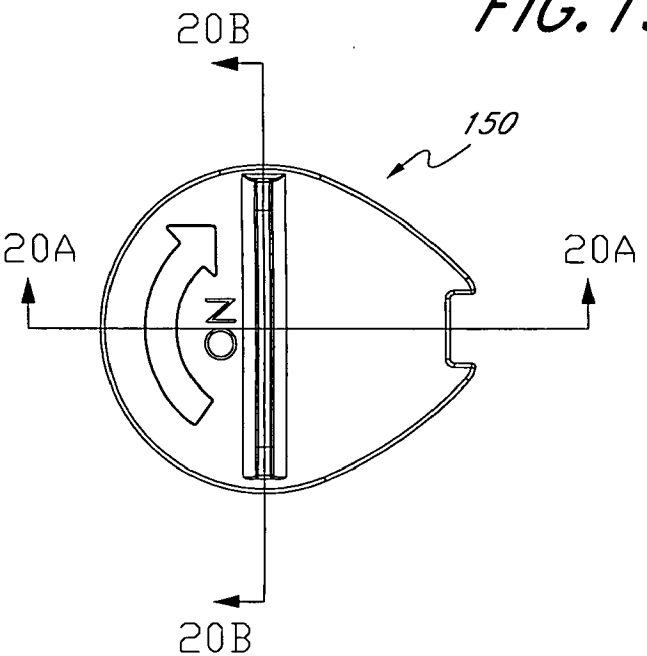
FIG. 20 is a top view of the first component of FIG. 12.
Figure 22:
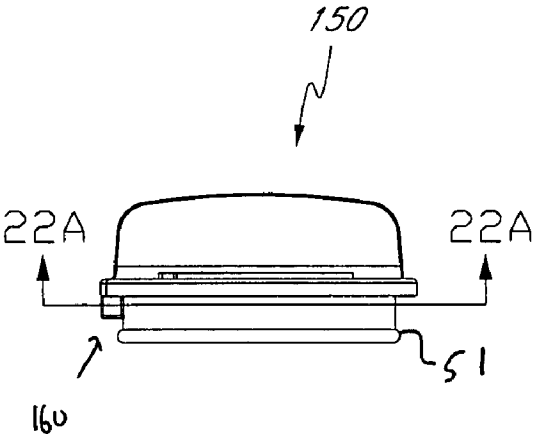
FIG. 22 is a front vie of the first component of FIG. 19.
Figure 22A:
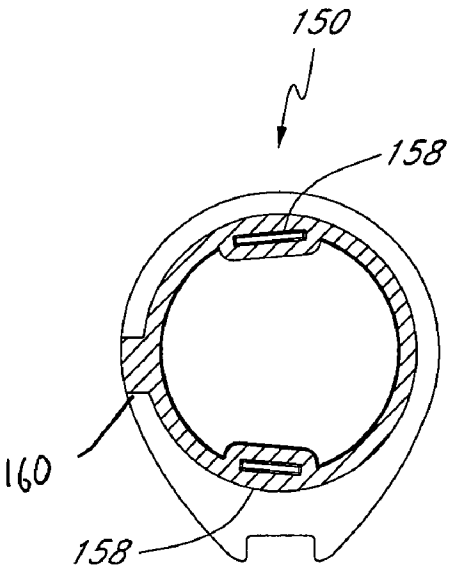
FIG. 22A is a cross-sectional view taken along line 22A-22A of FIG. 22.

The first component 150 is shown in detail in FIGS. 19-22A. The first component 150 includes the valve cap 21 and handle 24. The valve cap 21 includes an upper surface 151 from which the handle 24 extends and a lower surface 153. An annual flange 154 extends downwardly from the lower surface 153 to form a counter bore 155 generally opposite the handle 24. The outer surface 156 of the annular flange 154 forms the annular protrusion 51, described above, which secures the valve 20 within the inner bore 22. With particular reference to FIGS. 20A, 20C and 22A, the lower surface of the annular flange 154 includes a pair of rectangular notches or indentations 158.

Figure 21:
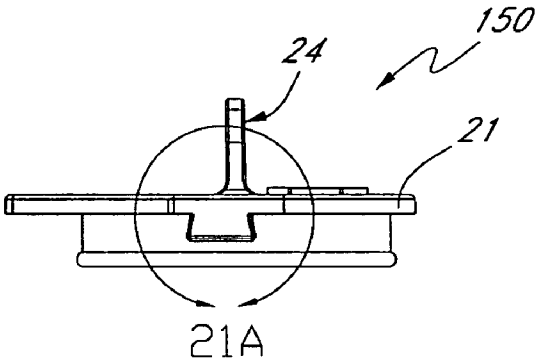
FIG. 21 is a left side view of the first component of FIG. 19
Figure 21A:
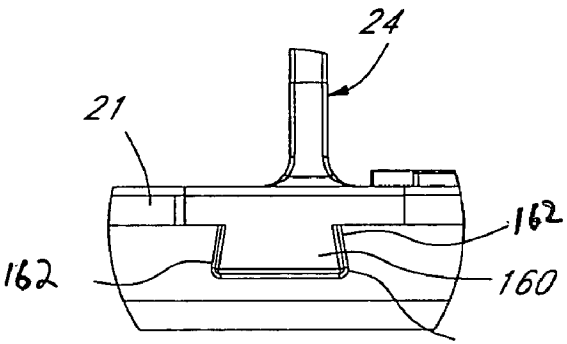
FIG. 21A is an enlarged view of a portion of FIG. 21.

With reference to FIGS. 10 and 21A, the first component 150 advantageously includes a protrusion 160. When the valve 20 is assembled into the housing 14, the protrusion fits within a groove 164 (see FIG. 10) formed on the edge of the housing. The interaction of the protrusion 160 and groove 164 provide rotational stops, which limit the rotation of the valve 20 between the "on" and "off" positions. The protrusion 160 may include slanted or angled sides 162 to prevent the protrusion 160 from lifting over the edge of the groove 164.

The second component 152 is shown in detail in FIGS. 23-27. The second component 152 generally comprises a cap shaped body 166 that includes a cylindrical wall 168 and a lower wall 170. The body 166 forms the suction generating surface 57, opening 59, annular flange 116 described above. A rectangular opening 172 is formed in the cylindrical wall 168 generally opposite the opening 59 to form in part the discharge outlet of the assembly 10. The upper portion of the discharge outlet is formed by the lower surfaces of the first component 152. A pair of rectangular flanges 174 extend from the upper surfaces of the cylindrical wall. The rectangular flanges 174 are configured to fit within the indentations 158 described above. In this manner, the flanges 174 and indentions 158 rotationally couple the first component 150 to the second component 152. Adhesives may be used to couple the two components 150, 152 together.

FIGS. 34-42B illustrate a modified embodiment of a sprayer head assembly 200. In these FIGS., like elements to those shown in FIGS. 1-33C are designated with like reference numerals, preceded by the numeral "2". When such components are not described in detail below, reference may be made to the description above.

With initial reference to FIGS. 34-36, the sprayer head assembly 200 includes a sprayer head 214, a container connection portion 216, a supply fluid connection portion 18, and a rotatable control valve 220. The valve 220 is moveably positioned in a cylindrical bore 222 (see FIG. 37) that is formed in the sprayer head 214 of the sprayer head assembly 200. The valve includes a gripping area or handle 224 that is mounted onto a valve cap 221. As with the previous embodiment, an operator opens and closes the valve 220 by twisting the handle 224 such that the valve 220 rotates about a substantially vertical axis.

With reference to FIG. 37, In the illustrated embodiment, the container connection portion 216 includes a conventional rotatable coupler 226 and a washer 228. The rotatable coupler 226 may have internal threads 230 that cooperate with corresponding threads (not shown) formed on the neck of the container.

With reference to FIG. 38., when the sprayer head assembly 200 is installed onto the container, the interior of the container is in communication with a chemical passage 232 that is also in communication with the interior of the cylindrical bore 222. As with the previous embodiment, the chemical passage 232 is defined in part by a downwardly depending chemical flow tube or dip tube 234. The dip tube 234 extends into the container and preferably terminates near a bottom surface of the container. The chemical passage 322 is also defined in part by an internal passage 328, which is formed in the sprayer head 14. The internal passage 238 communicates with the interior of the cylindrical bore 222 and the dip tube 234. The dip tube 234 is secured in fluid communication with the internal passage 238 by a sleeve 236. Although, in the illustrated arrangement the chemical passage 232 is defined by two components (the dip tube 234 and the internal passage 238), it should be appreciated that the chemical passage 232 can be defined by a single component or more than two components. The illustrated arrangement, however, is preferred because it is easy to manufacture and yet uses a small number of components.

Preferably, the sprayer head assembly 200 includes a vent passage 252, which is shown in FIG. 38. In the illustrated arrangement, the vent passage 252 is defined by a small hole formed in the head 214 of the assembly. As with the chemical passage 232, the vent passage 252 communicates with the interior of the container when the assembly 200 is mounted onto the container. The vent passage 252 extends up through head 214 and communicates with the interior of the cylindrical bore 222. In the illustrated embodiment, the vent passage 252 lies generally parallel to (and spaced along the axis of the valve from) the interior passage 232. Although, in the illustrated arrangement the vent passage 252 is formed on the assembly 200, it should be appreciated that the vent passage 252 can be located on the container. However, the illustrated arrangement is preferred because, as will be explained below, it enables the vent passage 252 to be opened and closed with the chemical passage 232.

With continued reference to FIG. 37, the supply fluid connection portion 218 may include a conventional rotatable coupler 240 and a washer 242. The coupler 240 includes threads 244 that cooperate with corresponding threads (not shown) formed on the supply fluid source. One of ordinary skill in the art will appreciate that other configurations can be used to connect the assembly 200 to the supply fluid source.

The sprayer head assembly 200 includes a supply passage 246. The supply passage 246 is in communication with the supply fluid source and the interior of the bore 222. In the illustrated arrangement, the supply passage 246 is defined in part by a side wall 300 of the sprayer head 214. The side wall 248 extends from the coupler 240 towards the cylindrical bore 222.

As seen in FIGS. 36 and 37, the valve 220 is constructed with two outer walls 254 that define a cylindrical periphery for sliding engagement with the interior wall of the cylindrical bore 222. Preferably, the outer wall 254 near the handle 224 includes an annular protrusion 251 for engaging an annular groove 253 that is formed along the interior wall of the cylindrical bore 222. Accordingly, the valve 220 is inserted into the sprayer head 214 by snap-fitting the valve 220 into the annular groove 253. Once snap-fitted, the valve 220 can rotate within the cylindrical bore 222 but is secured axially by the engagement of the outer wall 254 with the annular groove 253. The bore 222 is closed at one end by a bottom wall 223 that is preferably integrated with the assembly head 214. The bore 222 is closed at the other end by the valve cap 221.

In order to reduce the amount of material used in the valve 220, the valve 220 is preferably hollowed out. That is, several gaps 255 are formed in the body of the valve 220. These gaps 255 are positioned so as not compromise the structural integrity of the valve 220.

As with the previous embodiment, the valve 220 controls the flow of chemical through the assembly 200. The valve 220 also preferably controls the flow of supply fluid through the assembly 200. More preferably, the valve 220 also controls the communication of the vent passage 252 with atmospheric pressure.

Accordingly, as best seen in FIG. 40, the valve 220 defines at least in part a first passage 256. The first passage 256 is configured and positioned within the valve 220 such that when the valve 220 is an open position (i.e., the position shown in FIG. 40) the first passage 256 is aligned with and communicates with the chemical passage 232.

As seen in FIG. 40, the first passage 256 preferably communicates with a generally cylindrical metering orifice 274 that preferably terminates within a graduated suction generating recess 276, which is formed on a suction generating surface 257. Preferably, the valve 220 defines the metering orifice 274, the suction generating recess 276 and the suction generating surface 257. However, it should be appreciated that several advantages of the present invention can be achieved in an arrangement where the metering orifice 274, the suction generating recess 276 and/or the suction generating surface 257 are not defined by the valve 220.

As seen in FIG. 40, the valve 220 also defines, at least partially, a second passage 258 that is aligned with the supply passage 246 when the valve 220 is in the open position. The second passage 258 is preferably defined by the suction generating surface 257, the inner surface of the cylindrical bore 222, and a top wall 312 defined by the valve 220. It should also be appreciated that the second passage 258 can be defined entirely by the valve 220. That is, interior surface of the cylindrical bore 222 can be replaced, wholly or in part, by an additional wall of the valve 220. However, the illustrated arrangement is preferred for several reasons. For example, this arrangement reduces the amount of material need to form the valve 220.

With continued reference to FIG. 41, the valve 220 includes a bottom wall 305 that lies generally next two the bottom wall 223 of the assembly. In this embodiment, the bottom wall 305 of the valve 220 forms the opening 309 for the chemical passage 256 and has an opening 307 for the vent passage. In the open position, both openings 309, 307 are aligned with the respective internal passage 238 and vent passage 252. Sealing portions and/or the elastomer, rubber, or rubber-like member may be positioned on the bottom wall 305 of the valve 220 and/or the bottom wall 223 of the assembly 214. As will be explained in more detail below, in a closed position, the openings 305, 307 of the valve 220 are not aligned with the internal passage 238 and vent passage 252 such that the valve 220 closes these passages and thereby prevents leaks into the internal bore 222.

As best seen in FIGS. 41A and 42A, in the open position both openings 309, 307 are aligned with the respective internal passage 238 and vent passage 252. As shown, in FIGS. 42B and 42B, in a closed position, both openings 309, 307 are not aligned with the respective internal passage 238 and vent passage 252. In the closed position, the the bottom wall 305 of the valve 220 preferably blocks both passages 238, 252. In modified embodiments, the openings 309, 307 may be arranged to block only one of the passages 238, 252. For example, in the closed position, one of the openings 309, 307 may be aligned with the internal passage 238 or the vent passage 252. As mentioned above, the valve 220 or the inner bore 222 may be provided with various combinations of sealing members, coatings and/or integrally formed pieces preferably made from a elastic material (e.g., elastomer, rubber or rubber like material). In one preferred embodiment, the wall 305 of the valve is provided with one or more sealing members positioned within a recess that lies over preferably both passages 238, 252 in the closed position. Preferably, in the open position, the one or more sealing members also form an annular seal around the passages 238, 252 to prevent leakage into the inner bore 222. A small opening 261 (see FIG. 40) may be provided in the valve 220 to place the vent passage 252 in communication with atmospheric source.

In operation when the valve 220 is in the open position (FIG. 40), a stream of pressurized carrier fluid is discharged into the second passage 258. As the carrier fluid flows over the suction generating surface 257, a suction force is created that draws chemical through the dip tube 234, internal passage 238, and first passage 256 and into the stream of carrier fluid. The upwardly inclined orientation of the suction generating surface 257 helps to generate the suction force. Venting is provided through the vent passage 252 and vent opening 307.

Preferably, the chemical and carrier fluid is directly discharged from the assembly 200 through the second passage 258. A hood (not shown) may be provided on the assembly 214 to direct the fluid out of the assembly and to prevent splashing on the user. The upwardly inclined orientation of the suction generating surface 257 of the valve 220 also helps to direct the chemical and carrier fluid stream away from the user. It should also be appreciated that an additional outlet nozzle could be added to the assembly 200 to further direct the water and chemical flow. Such a nozzle can extend from the second passage 258 and would offer additional control of the carrier fluid and chemical stream.

When the valve is rotated to the closed position (see e.g., FIG. 38), the carrier passage 246 is closed by the valve 220. In this position, the wall 254 of the valve covers the carrier fluid passage 246. As discussed above, inner bore 222 and/or the valve 220 may be configured in a variety of ways to provide a tight seal between the valve 20 and the carrier fluid passages. In one embodiment, the wall 254 of the valve 220 may be provided with various combinations of sealing members, coatings and/or integral formed materials that surround the carrier fluid passage 246 in the close position to prevent leakage past the valve 220. In addition, as explained above with respect to FIGS. 41A-42B, the valve 220 may be configured to block the chemical passage 232 and the vent passage 252 in the closed position. In such embodiments, the valve 220 forms a tight seal over these passages as well in the closed position to prevent leakage.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A sprayer head assembly for dispensing a chemical stored in a container; the sprayer head assembly comprising:

a body that includes a chemical passage that is communication with a cavity in the container, a carrier fluid passage that is in communication with a carrier fluid source; a vent passage that is in communication with the cavity in the container, and a bore formed that is in communication with the chemical, carrier fluid and vent passages; and a valve moveably positioned at least partially within the bore, the valve defining, at least in part, a first passage and a second passage, the first passage and the second passage merging at the valve, the first passage being configured so as to be in communication with the chemical passage when the valve is in an open position, the second passage is configured so as to be in communication with the carrier fluid passage when the valve is in the open position, the first and second passages also configured so as to not be in communication with the chemical and carrier fluid passages when the valve is in a closed position;

the valve further comprising one or more sealing portions positioned on the valve so as to block both the chemical, the carrier fluid and the vent passages when the valve is in said closed position; and wherein the valve is configured to rotate about an axis that extends in a generally vertical direction and wherein the bore includes lower surface that includes a counter bore and the valve includes valve stem configured to fit within the counter bore.

2. The assembly as in claim 1, wherein the chemical passage communicates with the counter bore.

3. The assembly as in claim 2, wherein the vent passage communicates with the counter bore.

4. The assembly as in claim 3, wherein valve stem includes a sealing member positioned within the counter bore.

5. The assembly as in claim 4, wherein the sealing member includes a transition passage that places the chemical passage in communication with the first passage when the valve is in the open position.

6. The assembly as in claim 4, wherein the sealing member includes a vent channel that places the vent passage in communication an atmospheric pressure source with the valve is in the open position.

7. The assembly as in claim 4, wherein, when the valve is in the closed position, the sealing member blocks the chemical passage and the vent passage.

8. The assembly as in claim 1, wherein the valve includes a handle.

9. The assembly as in claim 8, wherein the handle is positioned, at least partially, outside the bore.

10. The assembly as in claim 9, wherein the valve is formed from at least a first component and a second component that are coupled together, the first component forming, at least in part, the handle, and the second component, forming at least in part, the first passage and the second passage.

11. The assembly as in claim 2, wherein the valve includes a vent opening.

12. The assembly as in claim 8, wherein the handle is positioned, at least partially, outside the bore.

13. The assembly as in claim 12, wherein the valve is formed from at least a first component and a second component that are coupled together, the first component forming, at least in part, the handle, and the second component, forming at least in part, the first passage and the second passage.

14. The assembly as in claim 9, wherein the bore includes lower surface that includes a counter bore and the valve includes valve stem configured to fit within the counter bore.

15. The assembly as in claim 14, wherein the chemical passage communicates with the counter bore.

16. The assembly as in claim 15, wherein the vent passage communicates with the counter bore.

17. The assembly as in claim 16, wherein valve stem includes a sealing member positioned within the counter bore.

18. The assembly as in claim 16, wherein the sealing member includes a transition passage that places the chemical passage in communication with the first passage when the valve is in the open position.

19. The assembly as in claim 16, wherein the sealing member includes a vent channel that places the vent passage in communication an atmospheric pressure source with the valve is in the open position.

20. The assembly as in claim 16, wherein, when the valve is in the closed position, the sealing member blocks the chemical passage and the vent passage.

* * * * *